US009611869B2

(12) United States Patent
Merrill

(10) Patent No.: US 9,611,869 B2
(45) Date of Patent: Apr. 4, 2017

(54) SLIM MOBILE HYDRAULIC FLUID COOLING ASSEMBLY

(71) Applicant: GARDNER DENVER, INC., Wayne, PA (US)

(72) Inventor: Travis Austin Merrill, Fowler, IL (US)

(73) Assignee: GARDNER DENVER, INC., Wayne, PA (US)

( * ) Notice: Subject to any disclaimer, the term of this patent is extended or adjusted under 35 U.S.C. 154(b) by 754 days.

(21) Appl. No.: 13/944,298

(22) Filed: Jul. 17, 2013

(65) Prior Publication Data

US 2015/0020995 A1 Jan. 22, 2015

(51) Int. Cl.

| | |
|---|---|
| ***F15B 1/26*** | (2006.01) |
| ***F28D 1/053*** | (2006.01) |
| *F01M 5/00* | (2006.01) |
| *F28F 9/04* | (2006.01) |
| *F15B 21/04* | (2006.01) |

(52) U.S. Cl.

CPC ..... *F15B 1/26* (2013.01); *F28D 1/05366* (2013.01); *F01M 5/002* (2013.01); *F15B 21/041* (2013.01); *F15B 21/042* (2013.01); *F28F 9/04* (2013.01)

(58) Field of Classification Search

CPC ..... F28D 1/024; F28D 1/05366; F15B 1/26; F15B 1/265

USPC ..... 165/41, 122; 123/41.49, 41.57; 180/68.1

See application file for complete search history.

(56) References Cited

U.S. PATENT DOCUMENTS 2,588,778 A * 3/1952 Tibeau ..... F01M 1/20 137/112
3,502,036 A * 3/1970 Raymond ..... F04B 23/02 137/798
3,604,205 A * 9/1971 Geselbracht ..... F15B 1/265 137/207
3,960,174 A * 6/1976 Latimer ..... F15B 1/26 137/563
4,241,578 A * 12/1980 Keene ..... F15B 1/26 137/575
4,454,641 A * 6/1984 Haas ..... F24F 13/30 165/125
5,649,587 A * 7/1997 Plant ..... F01P 5/06 123/41.49
5,850,872 A * 12/1998 Cesaroni ..... F01P 5/04 165/122

(Continued)

OTHER PUBLICATIONS

Statement of Related Utility Application.

*Primary Examiner* — Len Tran

*Assistant Examiner* — Gustavo Hincapie Serna

(74) *Attorney, Agent, or Firm* — Michael Best & Friedrich LLP

(57) ABSTRACT

A mobile hydraulic cooling assembly has a hydraulic fluid reservoir with a second interior surface offset from a first interior surface. The portion of the second surface offset is not opposite any of the first interior surface in the vertical direction. An air chamber, into which air passes into or out of through a heat exchanger, has an angled exterior surface formed from the reservoir which delimits the air chamber. A fill entry closure which covers a fill entry into the reservoir is accessible by the hands of an operator when a moveable closure of the assembly is in an open position. At least two reservoir portions delimiting a hollow of the reservoir overlap a bottom facing surface and bottom of a truck rail when the cooling assembly is mounted to the truck rail.

26 Claims, 17 Drawing Sheets

(56) References Cited

U.S. PATENT DOCUMENTS

| | | | | |
|---|---|---|---|---|
| 6,116,454 | A * | 9/2000 | Henderson | F15B 1/26 137/571 |
| 6,688,328 | B2 * | 2/2004 | Van Wie | F15B 1/26 137/354 |
| 6,913,040 | B2 * | 7/2005 | Crossman | B01D 29/117 137/171 |
| 6,997,239 | B2 * | 2/2006 | Kato | F01P 5/06 123/195 A |
| 2011/0284089 | A1 * | 11/2011 | Knuth | F15B 1/26 137/1 |
| 2013/0240069 | A1 * | 9/2013 | Smith | F15B 21/044 137/574 |

* cited by examiner

SLIM MOBILE HYDRAULIC FLUID COOLING ASSEMBLY

FIELD

The present invention concerns a slim mobile hydraulic cooling assembly for mounting on a frame rail of a truck.

BACKGROUND

Trucks, such as those that trail tanks, use hydraulic fluid to perform work such as running hydraulic motors on the truck to convey material. As the hydraulic fluid performs work, the fluid heats up. To cool the fluid and to keep it from overheating, a truck will have a mobile hydraulic fluid cooling assembly. The assembly will usually be mounted on the frame rail of the truck.

A known cooling assembly includes a heat exchanger; a fan; a fan motor coupled to the fan; a hydraulic fluid reservoir; a hydraulic fluid filter; and hydraulic fluid conduits. The conduits typically include flexible hoses and fittings to couple the hoses as needed to the heat exchanger; filter and control block. If the fan motor is hydraulically driven, some of the hoses would be coupled to the fan motor by fittings. The assembly, in connection with the heat exchanger and other structure of the assembly, forms an air-box into which air is drawn by the fan through the heat exchanger and exhausted from the air-box to atmosphere. The assembly also includes structure to carry the above items and mount the above items to the truck frame rail.

In operation a known cooling assembly, as described above with a hydraulic fan motor, generally operates as follows. The fluid, after it performs work, now called low pressure fluid is routed, by way of a return conduit into the control block. The return conduit which can include a hose and fitting, is connected to the control block by the fitting. The fitting is coupled to the block at a return port opening into the block. The fluid from the control block passes into the heat exchanger. A hose forms part of the passage. As the fluid passes through the heat exchanger, it is cooled by air being drawn through the heat exchanger into the air-box by the fan. The air is exhausted from the air-box by the fan to atmosphere. The fluid, after it exits the heat exchanger enters a hose. Downstream of the hose is a filter which receives the fluid after it has passed through the hose. The fluid passes through the filter. After the fluid passes through the filter it is emptied into the reservoir. From the fluid reservoir, fluid is drawn out of the reservoir by a pump. The fluid is drawn into the pump and is then again pressurized by the pump to perform work. The fluid, after it performs work, is then recirculated, as described above, through the heat exchanger and back to the reservoir.

Some of the fluid as it is pressurized by the pump, but before it performs work, is routed to the hydraulic fan motor. A bypass conduit routes the fluid, high pressure fluid, from a high pressure line, to the control block. Downstream of the control block, the fluid is routed through a hose into the fan motor. The fluid exits the fan motor. After the fluid exits the fan motor it enters a hose. After it exits the hose it enters the filter. After the fluid passes through the filter, it is emptied into the reservoir.

SUMMARY

An embodiment of the invention includes a mobile hydraulic fluid cooling assembly having a hydraulic fluid reservoir with a second interior surface offset from a first interior surface. The portion of the second surface offset is not opposite any of the first interior surface in a vertical direction. An air chamber, wherein air passes into or out of through a heat exchanger, has an angled exterior surface which forms part of the reservoir and which delimits the air chamber. A fill entry closure, which covers a fill entry into the reservoir, is accessible by the hands of an operator when a moveable closure of the assembly is in an open position. A first curved wall of a frame of the cooling assembly is proximate a first fitting forming a first suction port of the cooling assembly. The first suction port is at a first side portion of the reservoir. At least two portions delimiting a hollow chamber of the reservoir overlap a bottom facing surface and bottom of a truck rail when the cooling assembly is mounted to the truck rail

DETAILED DESCRIPTION

Figure 1:
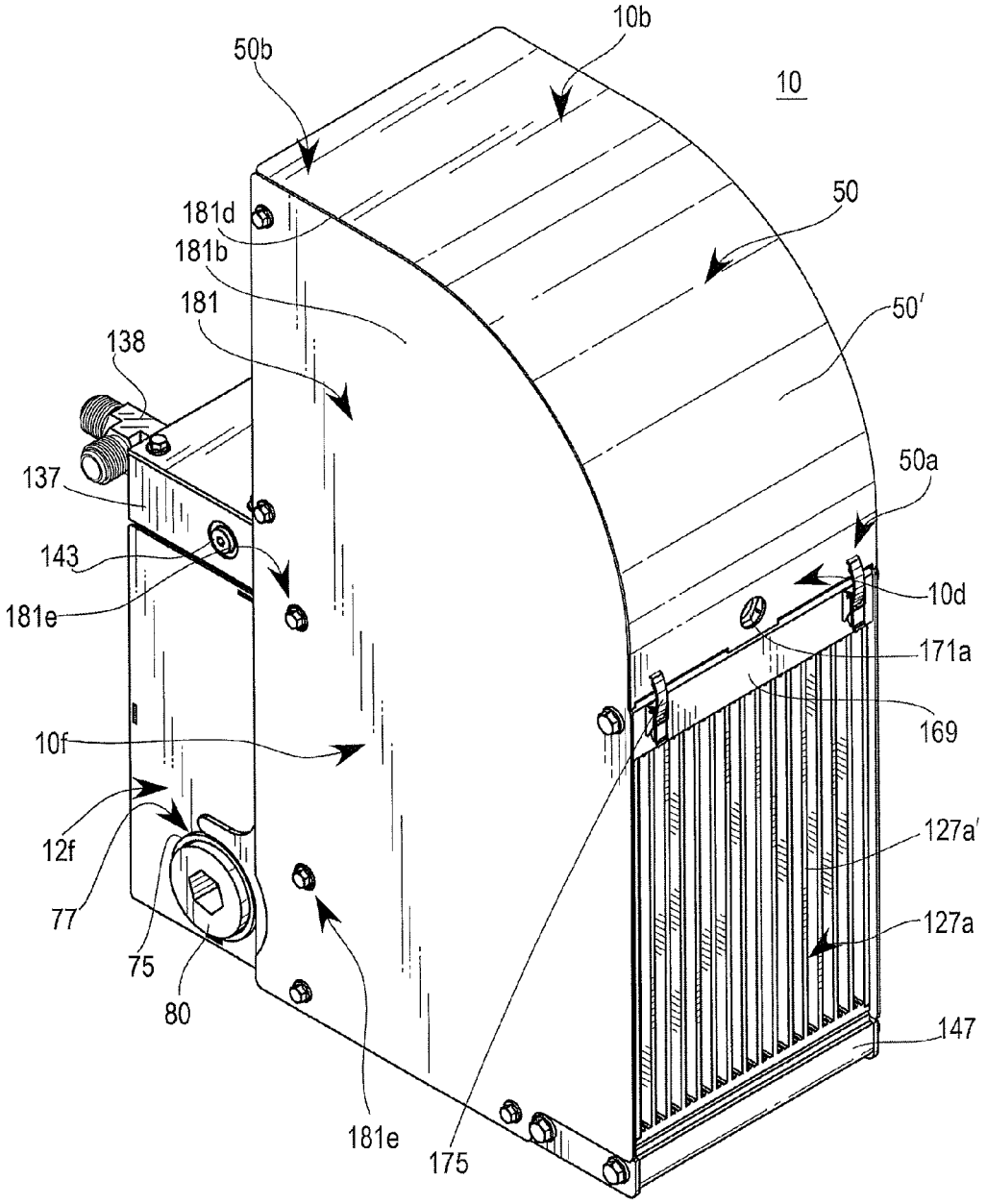
FIG. 1 is a top, front, left sided isometric view of a mobile hydraulic cooling assembly embodying the features of the present invention.

While embodiments of this invention can take many different forms, specific embodiments thereof are shown in the drawings and will be described herein in detail with the understanding that the present disclosure is to be considered as an exemplification of the principles of the invention, and is not intended to limit the invention to the specific embodiment illustrated.

The mobile hydraulic cooling assembly 10 embodying the present invention has a hydraulic fluid reservoir 12. The reservoir has a hollow chamber 15 defined by portions of the reservoir which include a first portion 17 and a second portion 18. A first interior surface 20 of the first portion 17 and a second interior 22 surface of the second portion 18 delimit the hollow chamber 15. The first interior surface 20 delimits a first interior end 20' of the reservoir and the second interior surface 22 delimits a second interior end 22' of the reservoir. The reservoir has a distance 25 measured in a vertical direction 91 from the first interior end 20' to the second interior end 22'. The vertical distance is an internal height of the reservoir. The vertical distance separates the first 20 and second 22 interior surfaces. The greatest vertical distance separating the internal surfaces is a maximum vertical distance. The distance 25 is a maximum vertical distance. A longest straight line 27 extending from the first interior surface 20 to the second interior surface 22 intersects a line 25' drawn along the vertical direction 91 at an angle greater than 90 degrees and less than 180 degrees. The angle is preferably between 141° and 155°. It is shown as 148°. A shortest straight line 29 from the first interior surface 20 to the second interior surface 22 intersects the line 25' drawn along the vertical direction 91 at an angle of greater than 90 degrees and less than 180 degrees. The angle is preferably between 172° and 176°. It is shown as 174°. The angles are determined going in the counter clockwise direction and starting at the longest straight or shortest straight line in the positive X direction. The 0,0 coordinates are at the intersection of the lines.

The reservoir has a further portion 31, referred to below as an eighth portion, with an interior surface 31' delimiting the hollow chamber 15. The further portion 31 is angled relative to the second portion 18 going in a clockwise direction and starting from a line drawn along or parallel to the second interior surface 22 at an angle of less than 90 degrees; the angle is preferably between 30 and 50, and is shown as 40. The further portion 31 is angled relative to the first portion 17 going in a counterclockwise direction and starting from a line drawn along or parallel to the first interior surface 20 at an angle of greater than 90 degrees and less than 180 degrees; the angle is preferably between 130 and 150, and is shown as 140.

The reservoir has a third interior surface 33' delimiting the hollow chamber 15 and delimiting a third interior end 33" of the reservoir. The reservoir has a fourth interior surface 35' delimiting the hollow chamber 15 and delimiting a fourth interior end 35" of the reservoir. The reservoir has an interior depth. The depth is a horizontal distance 37 that separates the third and fourth interior surfaces 33', 35'. The greatest horizontal distance separating the third and fourth interior surfaces 33', 35' is a maximum horizontal distance. The distance 37 is a maximum horizontal distance. The term horizontal, as used herein with respect to the reservoir, is relative to the ground when the reservoir's first exterior surface 21 faces the ground.

The reservoir has a fifth interior surface 39' delimiting the hollow chamber 15. A shortest straight line 41 drawn between the fifth interior surface 39' and a portion the third interior surface 33' opposite the fifth interior surface 39' is Y. The distance Y is less than the interior depth 37 of the reservoir and less than the maximum horizontal distance 37 separating the third 33' and fourth 35' internal surfaces. The portion of surfaces 39' and 33' opposite each other form part of a sump area 43 of the reservoir.

Figure 2:
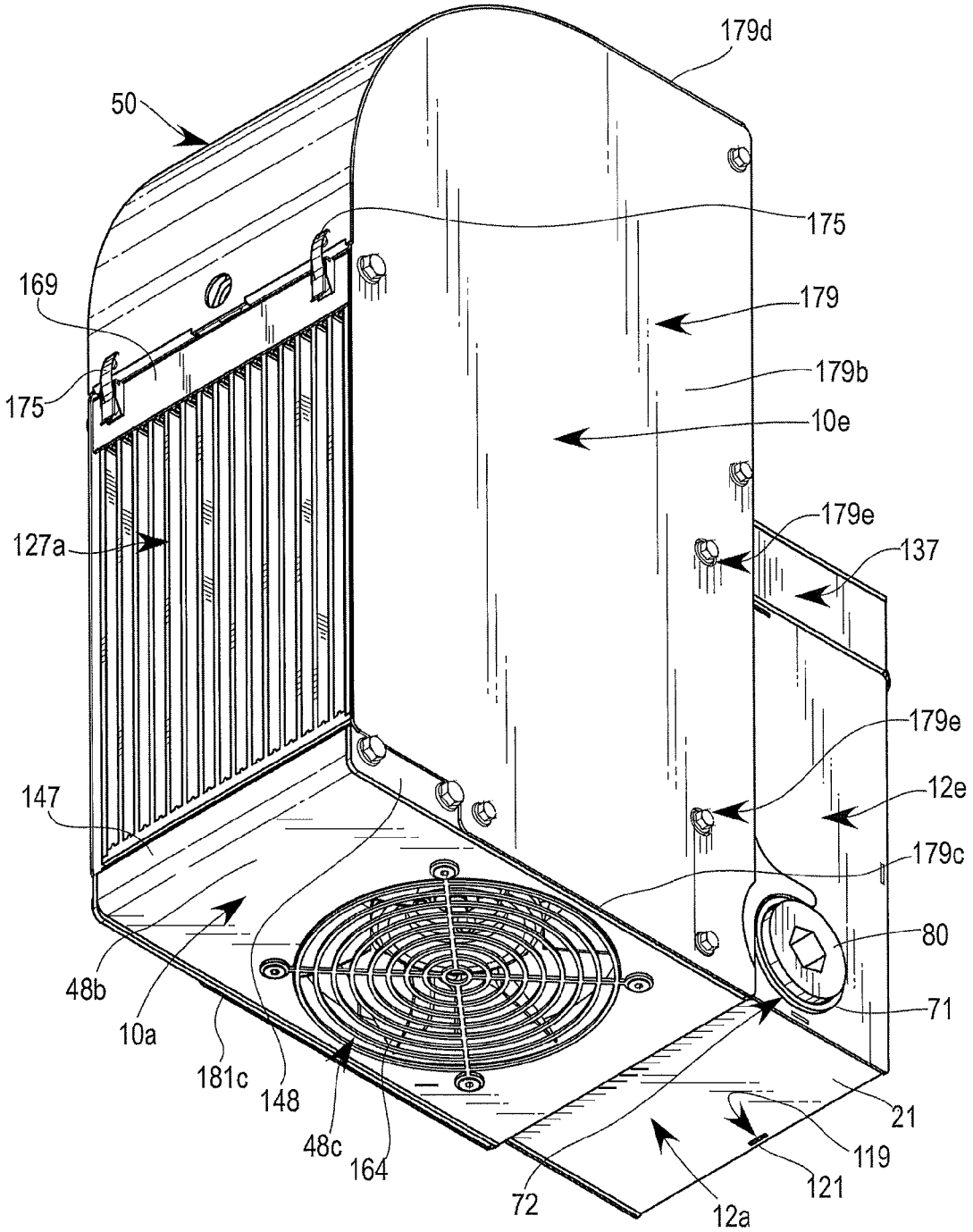
FIG. 2 is a bottom, front, right sided isometric view of the mobile cooling assembly of FIG. 1.
Figure 3:
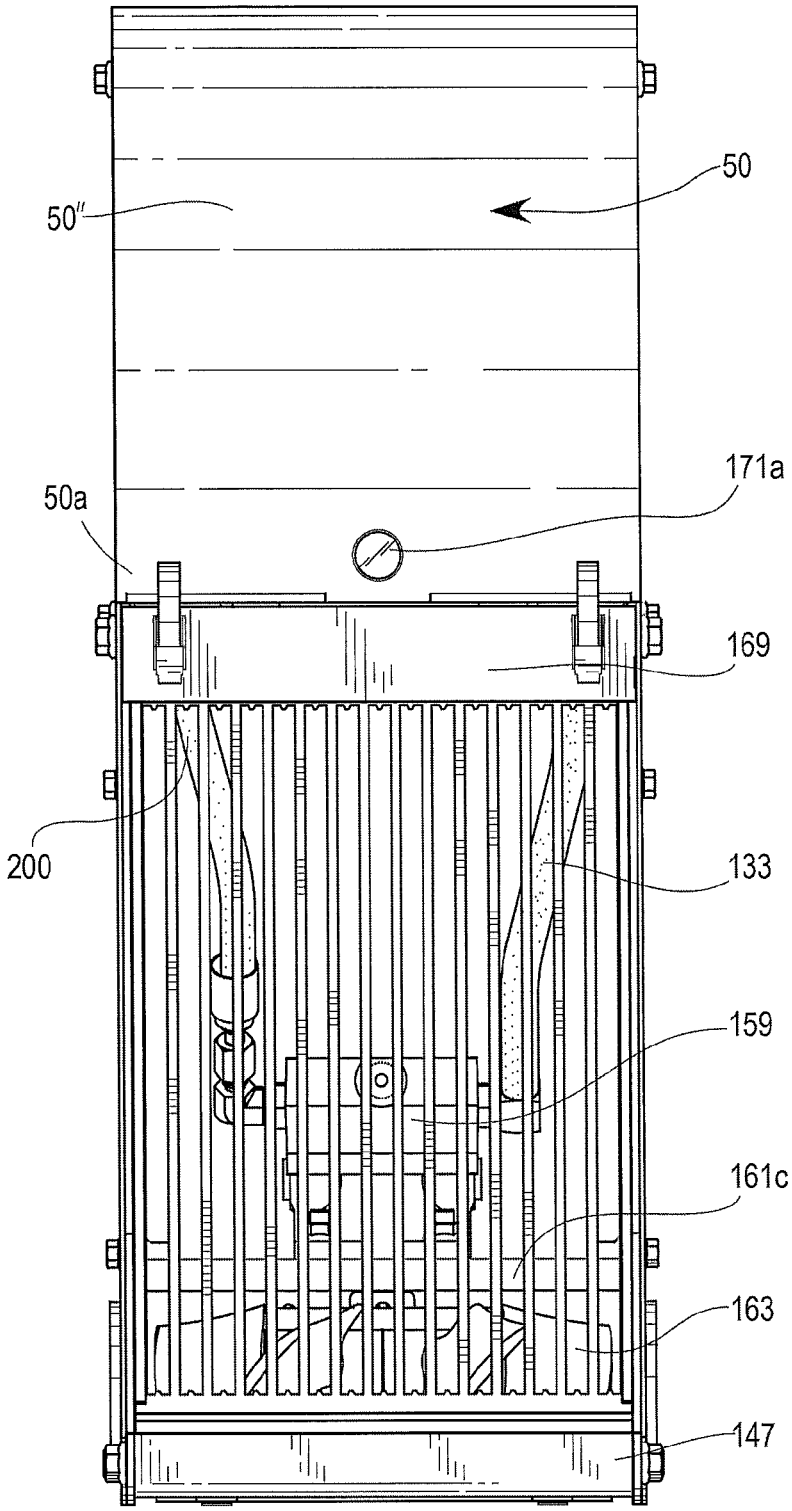
FIG. 3 is a front view of the mobile hydraulic cooling assembly of FIG. 1.
Figure 4:
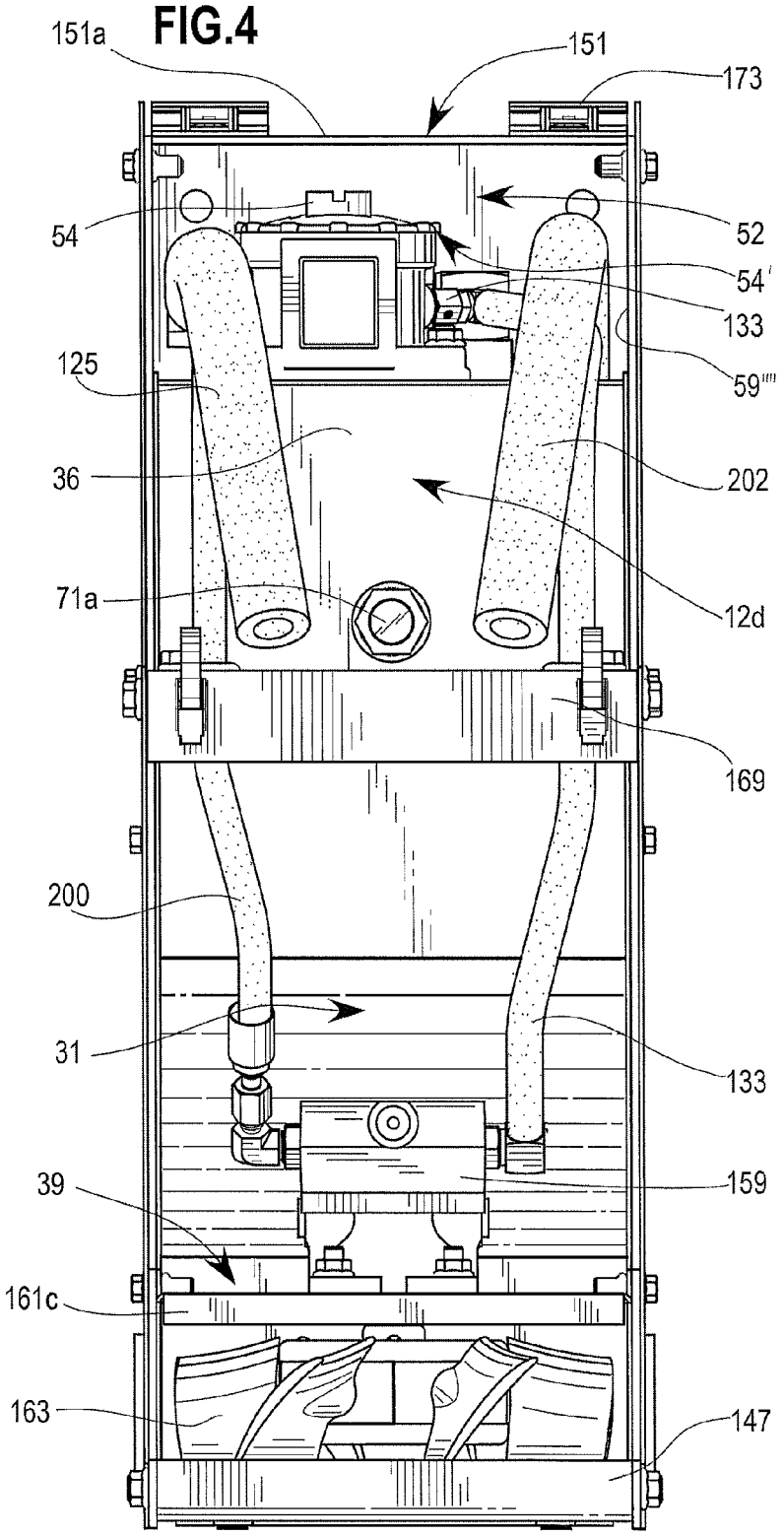
FIG. 4 is a front view of the mobile hydraulic cooling assembly of FIG. 1 with the heat exchanger and the closure, moveable from a closed to an open position, removed.
Figure 5:
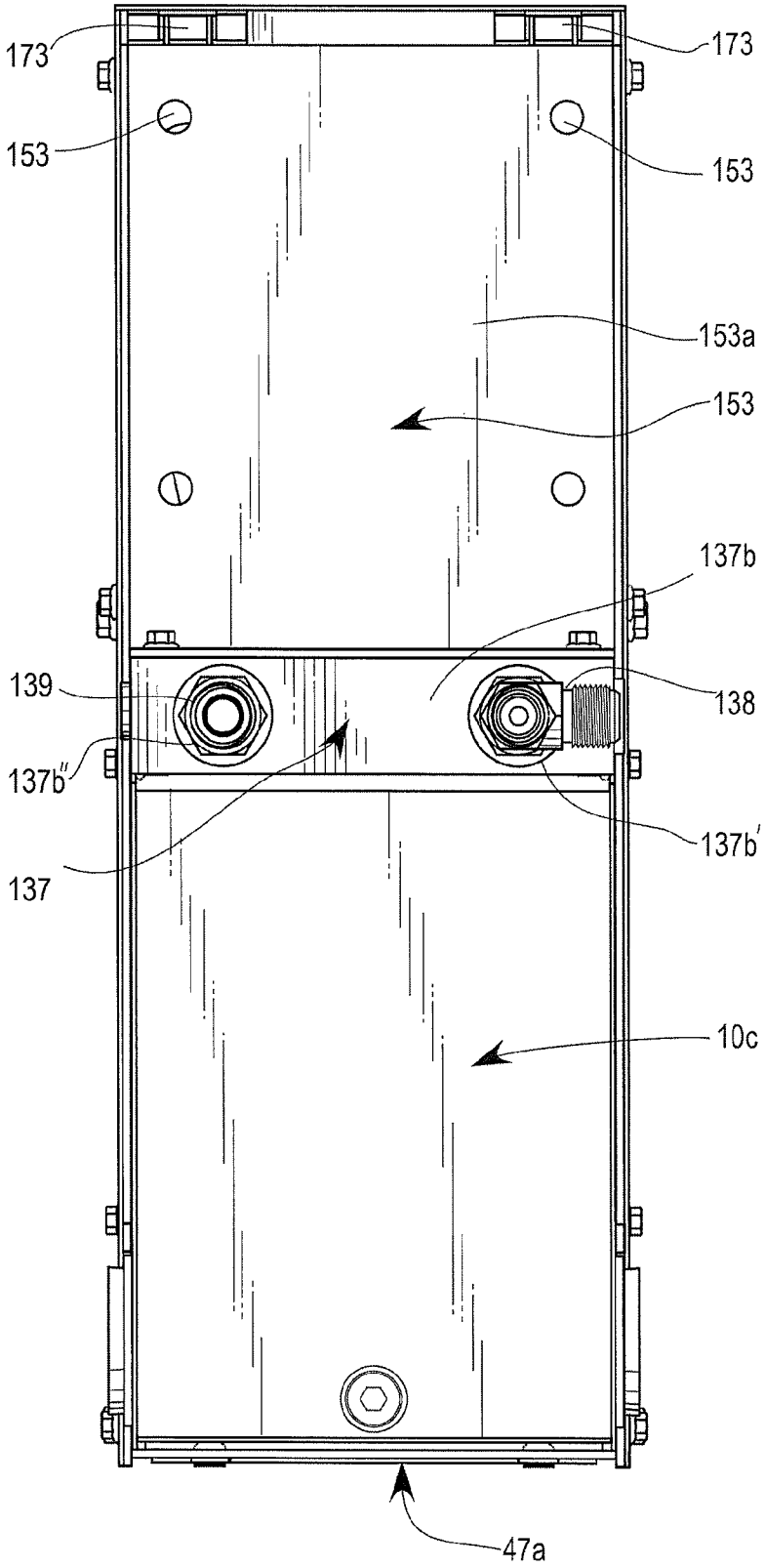
FIG. 5 is a rear view of the mobile hydraulic cooling assembly of FIG. 1.
Figure 6:
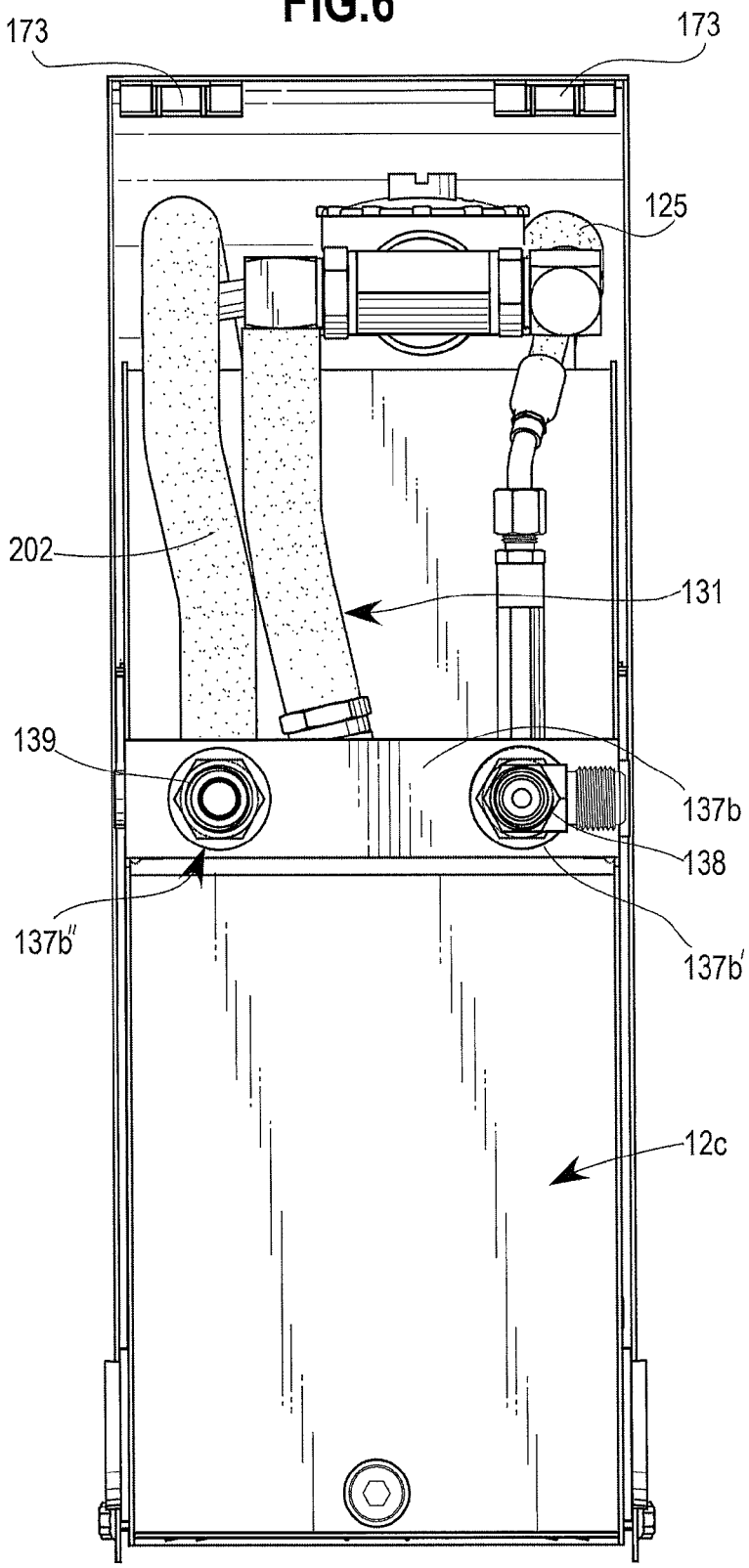
FIG. 6 is a rear view of the mobile hydraulic cooling assembly of FIG. 1 with the frame mount and uprights and cross member removed.

The cooling assembly includes a frame 47 coupled to the reservoir 12. The frame has a first end 47*a*, second end 47*b*, third end 47*c*, and fourth end 47*d* oriented along the same direction as the first end 10*a*, 12*a*, second end 10*b*, 12*b* third end 10*c*, 12*c* and fourth end 10*d*, 12*d*, respectively, of the cooling assembly 10 and the reservoir 12. The frame carries a closure 50 moveable from an open position to a closed position and vice versa. The dashed lines show the closure in the open position. The closure 50 has an interior surface 50" delimiting an open area 52 going in a direction from the open area 52 to the second end 10*b* of the assembly and in a direction going from the open area 52 to the fourth end 10*d* of the assembly. Disposed in the open area is a removable fill entry closure 54 which covers a fill entry 54' into the reservoir 12. When the closure 50 is in the open position, the open area 52 is open to the environment exterior to the closure 50; the closure 54 of the fill entry 54' is accessible by the hands of an operator. The operator can move the fill entry closure 54 to an open position and fill the reservoir 12 with hydraulic fluid. The closure 50, when in the closed position, as shown in FIGS. 1, 2 and 3 closes off the open area 52 so it is not accessible by the hands of an operator.

Open areas 58, 60 are delimited by respective frame portions 59, 61 of the frame. Respective curved walls 59', 61' delimit each open area 58, 60 in a direction which is along a vector which has a component going towards the second end 47*b* and component going towards the fourth end 47*d* of the frame. The vector component going towards the second end 47*b* goes in the vertical direction 91 and the component going towards the fourth end 47*d* goes in the first horizontal direction 400. Each open area 58, 60 have a respective opening 58', 60' into its respective open area 58, 60. Each opening 58', 60' is proximate a surface 59", 61" of its respective frame portion 59, 61. The surfaces 59", 61" each face away from the fourth end 47*d* of the frame 47. Each open area 58, 60 also opens through an exterior 59''', 61''' and interior 59'''' and 61'''' surface of its respective frame portion 59, 61. A flange 59*e*, 61*e* of each frame portion 59, 61, forms part of its respective frame portions 59, 61 curved wall 59', 61' and surface 59", 61". Each open area 58, 60 is configured to have a respective first aperture line 63, 65 that passes through the respective open area 58, 60 in a first direction without contacting the portion of the frame portion 59, 61 bordering the respective open area. The first direction is perpendicular to the exterior 59''', 61''' and interior 59'''', 61'''' surfaces of the respective frame portions 59, 61. Each open area 58, 60 is configured to have a second aperture line 67, 69 that passes into the respective open area 58, 60 in a second direction without contacting the portion of the frame portion 59, 61 bordering the respective open area. The second line 67, 69 of each open area is perpendicular to the first line of each open area. Each curved wall, 59', 61' delimiting each open area 58, 60 is generally arcuate. The curved wall 59' is proximate and may contact a fitting 71 of a respective suction port 72 at a first side portion 103 of the reservoir when the reservoir is coupled to the frame 47; and the curved wall 61' is proximate and may contact a fitting 75 of a respective suction port 77 at a second side portion 107 of the reservoir when the reservoir is coupled the frame 47. Suction portion 72 is at the first side 103 and is formed by hollow fitting 71 extending through a through opening in side 103; suction portion 77 is at the first side 107 and is formed by hollow fitting 77 extending through a through opening in side 107. Each curved wall 59', 61' provides an abutment for its respective fitting 71, 75 to reduce strain on the connection between the fitting 71, 75 and its respective side portion 103, 107 when a respective conduit is coupled to its respective fitting 71, 75. The curved side wall's 59', 61' can abut their respective fittings 71, 75 prior to being connected to their respective conduit. Alternatively, there can also be a slight gap between the fitting 71, 75 and its respective curved wall 59', 61' until the respective conduit is put under strain. When under strain the respective fitting 71, 75 abut its respective curved wall 59', 61'.

A filter 81 extends into the reservoir hollow chamber 15. A fluid outlet 81*a*' is formed in a housing 81*a* of the filter 81. An end surface 81*a*" delimiting an exterior end of the outlet 81*a*' is submerged in the hydraulic fluid in the reservoir 12 when the cooling assembly 10 is under normal operation. The end surface 81*a*" is away from the surface of the hydraulic fluid a minimum distance of 13 cm's and a preferred distance of 15 cm. The outlet 81*a*' is away from the interior surface of the second portion 18 a preferred distance, taken along a shortest straight, line of 25 cm's and a minimum distance of 22 cm. The end surface 81*a*' is a distance, measured in the vertical direction 91, along a longest straight line, spaced from the interior surface 31' of the portion 31 of 0.5 cm. The distance is preferably a distance between 0.5 and 2 cm.

In more detail the reservoir's first portion 17 first exterior surface 21 faces a direction opposite the direction the first interior surface 20 faces. The first portion 17 is at the first end 12*a* of the reservoir and a bottom. The first interior surface 20 at the first interior end 20' delimits the hollow chamber 15 of the reservoir 12 going from the chamber 15 in the direction towards the first end 12*a* of the reservoir. The first exterior surface 21 forms a first exterior end of the reservoir. The first interior surface 20 and the first exterior surface 21, respectively, each completely lie in a single respective plane and are each planar. The first interior surface 20 delimits an interior bottom of the hollow chamber 15 and interior floor of the reservoir; the first exterior surface 21 delimits an exterior bottom of the reservoir. The first surfaces 20, 21 and first portion 17 are all parallel to horizontal line 37'. The term horizontal, as used herein with respect to the reservoir, is relative to the ground when the reservoir's first exterior surface 21 faces the ground.

The reservoir's second portion 18 has a second exterior surface 23 that faces a direction opposite the direction the second interior surface 22 faces. The second portion 18, second interior surface 22, and second exterior surface 23 are parallel, respectively, to the first portion 17, first interior surface 20, and first exterior surface 21. The first interior surface 20 faces a direction opposite the second interior surface 22. The second portion 18 is at a second end 12*b* and top of the reservoir. The second interior surface 22 at the second interior end 22' delimits the hollow chamber 15 of the reservoir 12 going from the chamber 15 in the direction towards the second end 12*b* of the reservoir 12. The second exterior surface 23 forms a second exterior end of the reservoir. The second interior surface 22 and the second exterior surface 23, respectively, each completely lie in a single respective plane and are each planar. The second interior surface 22 delimits an interior top of the reservoir and interior top of the hollow chamber 15; the second exterior surface 23 delimits an exterior top of the reservoir. The second surfaces 22, 23 and second portion 18 are all parallel to the horizontal line 37'.

The longest straight line 27 extending from the first interior surface 20 to the second interior surface 22 intersects a first line perpendicular to both a first line 85 and a second line 87. The line perpendicular is the vertical line 25'. The first line 85 contacts a least one point on the first interior surface 20 and the second line 87 contacts at least one point on the second interior surface 22. The first line 85 and the second line 87 are two lines of a shape 89 consisting of four lines. The four lines are continuous and the shape has four interior right angles. The lines delimit an interior area circumscribed by the four lines. The interior area is as small as possible without a point on an interior surface of the reservoir delimiting the hollow both falling outside of the interior area and not contacting any of the lines forming the shape.

The second interior end 22' delimits an interior end of the reservoir spaced furthest away from the first interior end 20' of the reservoir 12; the distance measured along the first line 25' perpendicular. The second exterior surface 23 delimits an exterior surface of the reservoir furthest away from the first exterior surface 21 of the reservoir; the distance measured along the same line perpendicular 25'. The distance measured is a maximum vertical distance separating the first and second exterior surfaces. The distance measured is the exterior height of the reservoir. The term vertical, as used herein with respect to the reservoir, is relative to the ground 190 when the reservoir's first exterior surface faces the ground.

The second interior surface 22 is offset from at least a portion of the first interior surface 20 in the first horizontal direction 400. Off-set in the horizontal direction means the portions of the first interior 20 and second interior 22 surfaces offset, are offset such that neither of the portions are opposite each other in the vertical direction 91. In the shown embodiment, the entire second interior surface 22 is off-set from the entire first interior surface 20 in the first horizontal direction 400 such that neither surface is opposite the other in the vertical direction 91. The longest straight line and the shortest straight line extending from the first interior surface to the second interior surface will intersect the second line perpendicular 37' at an angle, going in the counterclockwise direction and starting from the second line perpendicular greater than 90 degrees and less than 180 degrees. The angle formed with the shortest straight line is 96°; the angle is preferably between 94° and 98°. The angle formed with the longest straight line is 122°; the angle is preferably between 120° and 124°. As always the starting point is in the positive X direction. Again the 0, 0 coordinates are at the intersection. The entire second interior surface 22 faces in a vertical direction 92 opposite the vertical direction 91 the entire first interior surface 20 faces.

The reservoir's third portion 33 has a third exterior surface 34 that faces a direction opposite the direction the third interior surface 33' faces. The third portion 33 is at third end 33" and rear of the reservoir. The third interior surface 33' at the third end 33" delimits the hollow chamber 15 of the reservoir 12 going from the chamber 15 in the direction towards third end 12*c* of the reservoir. The third exterior surface 34 delimits a third exterior end of the reservoir. The third interior surface 33' and the third exterior surface 34, respectively, each completely lie in a single respective plane and are each planar. The third portion 33, the third interior surface 33', and third exterior surface 34 are, respectively, perpendicular to the first portion 17, first interior surface 20, and first exterior surface 21. The third portion is perpendicular to the second portion 18. The third portion 33 and third surfaces 33', 34 are perpendicular to the horizontal line 37'. The third portion 33 extends away from the first portion 17 in the first vertical 91 direction towards the second line 87 contacting the second interior surface 22. The third portion 33 extends from an end of the first portion 17 at the third end 12*c* of the reservoir.

The reservoir's fourth portion 35 has a fourth exterior surface 36 that faces a direction opposite the direction the fourth interior surface 35' faces. The fourth portion 35 is at a fourth end 12*d* and front of the reservoir. The fourth interior surface 35' and the fourth exterior surface 36, respectively, each completely lie in a single respective plane and are each planar. The fourth interior surface at the fourth interior end 35" delimits the hollow chamber of the reservoir going from the chamber 15 in the direction towards the fourth end 12*d* of the reservoir. The fourth portion 35, fourth interior surface 35', and fourth exterior surface 36 are, respectively, perpendicular to the second portion 18, second interior surface 22, and second exterior surface 23. The fourth portion 35 is parallel to the third portion 33 and perpendicular to the first portion 17. The fourth interior surface 35' faces a direction opposite the direction the third interior surface 33' faces. At least a portion of the third interior surface 33' is not opposite, going in the direction 400, the fourth interior surface 35'. The fourth portion 35 and fourth surfaces 35', 36 are perpendicular to the horizontal 37'. The fourth portion 35 extends away from the second portion 18 in a second vertical direction 92 towards the first line 85 contacting the first interior surface 20. The fourth portion 35 extends from an end of the second portion 18 at the fourth end 12*d* of the reservoir.

A second line is perpendicular to another first line 93 and to another second line 95. The other first line 93 contacts at least one point on the third interior surface 33' and the other second line 95 contacts at least one point on the fourth interior surface 35'. The second line perpendicular is the horizontal line 37'. From line 93, line 37' extends towards line 95 in the first horizontal direction 400. The first line and the second line are two lines of a shape 89 consisting of four lines. The four lines are continuous and the shape has four interior right angles. The lines delimit an interior area circumscribed by the four lines. The interior area is as small as possible without a point on an interior surface of the reservoir delimiting the hollow both falling outside of the interior area and not contacting any of the lines making the shape.

The fourth interior end 35" delimits an interior end of the reservoir furthest away from the third interior end 33"; the distance measured along the second line perpendicular 37'. The fourth exterior surface 36 delimits an exterior end of the reservoir furthest away from the third exterior end of the reservoir; the distance measured along the same second line perpendicular 37'. The distance measured is also a maximum horizontal distance separating the third 34 and fourth 36 exterior surfaces. The distance measured is the exterior depth of the reservoir 12. The entire third interior surface 33' faces in a direction opposite the direction the entire fourth interior surface 35' faces.

The reservoir's fifth portion 39 has a fifth exterior surface 40 that faces a direction opposite the direction the fifth interior surface 39' faces. The fifth interior surface 39' delimits the hollow chamber 15 of the reservoir going from the chamber 15 in the direction away from the third end 12*c* of the reservoir. The fifth interior surface 39' and the fifth exterior surface 40, respectively, each completely lie in a single respective plane and are each planar. The fifth portion 39, fifth interior surface 39', and fifth exterior surface 40 are, respectively, perpendicular to the first portion 17, first interior surface 20, and first exterior surface 21. The fifth portion 39 is parallel to the third 33 and fourth 35 portions and perpendicular to the second portion 18. The fifth portion 39 and fifth surfaces 39', 40 are perpendicular to the horizontal line 37'. The fifth portion 39 extends away from the first portion 17 in the first direction 91 towards the second line 87 contacting the second interior surface 22'. The fifth portion 39 extends from an end of the first portion 17, opposite the end of the first portion 17, from which the third portion 33 extends. At least a portion of the fifth interior surface 39' is opposite and faces the third interior surface 33'.

The reservoir includes a sixth portion 97 having a sixth interior surface 97' and a sixth exterior surface 98. The sixth exterior surface 98 faces a direction opposite the direction the sixth interior surface 97' faces. The sixth interior surface 97' delimits the hollow chamber 15 of the reservoir 12 going from the chamber in the direction away from of the fourth end 12*d* of the reservoir. The sixth interior surface 97' and the sixth exterior surface 98, respectively, each completely lie in a single respective plane and are each planar. The sixth portion 97, sixth interior surface 97', and sixth exterior surface 98 are, respectively, perpendicular to the second portion 18, second interior surface 22, and second exterior surface 23. The sixth portion 97 is parallel to the third 33, fourth 35 and fifth 39 portions and perpendicular to the first portion 17. The sixth portion 97 and sixth surfaces 97', 98 are perpendicular to the horizontal line 37'. The sixth portion 97 extends away from the second portion 18 in the second vertical direction 92 towards the first line 85 contacting the first interior surface 20. The sixth portion 97 extends from an end of the second portion 18, opposite the end of the second portion 18, from which the fourth portion 35 extends. At least a portion of the fourth interior surface 35' is opposite and faces the sixth interior surface 97'. The fifth interior 39' surface and sixth interior surface 97' face opposite directions. A distance between the fourth interior surface 35' and the sixth interior surface 97', opposite the fourth interior surface 35', is X. The distance is measured along a shortest straight line between these surfaces. The distance X is less than the interior depth 37 of the reservoir and less than the distance Y between the third 33' and fifth 39' interior surfaces.

As measured along the interior height 25 of the reservoir, the sixth portion 97 has a length greater than the fifth portion 39; the fourth portion 35 has a length greater then sixth portion 97; and the third portion 33 has a length greater than the sixth portion 97.

The reservoir includes a seventh portion 100 having a seventh interior surface 100' and a seventh exterior surface 101. The seventh exterior surface 101 faces a direction opposite the direction the seventh interior surface 100' faces. The seventh interior surface 100' delimits the hollow chamber 15 of the reservoir going from the chamber 15 in the direction away from first end 12*a* of the reservoir. The seventh interior surface 100' and the seventh exterior surface 101, respectively, each completely lie in a single respective plane and are each planar. The seventh portion 100, seventh interior surface 100', and seventh exterior surface 101 are perpendicular, respectively, to the sixth portion 97, sixth interior surface 97', and sixth exterior surface 98. The seventh portion 100 is parallel to the first 17 and second 18 portions and perpendicular to the third 33, fourth 35 and fifth portions 39. The seventh portion 100 and seventh surfaces 100', 101 are all parallel to the line 37'. The seventh portion 100 extends away from the sixth portion 97 in a direction towards the other first line 93 contacting the third interior surface 33'. Only a portion of the seventh interior surface 100' is opposite and faces the first interior surface 20. A distance between the seventh interior surface 100' and the first interior surface 20, opposite seventh interior surface

100', is Z. The distance is measured along a shortest straight line between these surfaces. The distance Z is less than the interior height 25' of the reservoir and greater than the distance X between the fourth 35' and sixth 97' interior surfaces.

As measured along the interior depth of the reservoir, the length of the first portion 17 is greater than the length of the second first portion 17; the length of the seventh portion 100 is greater than the length of the second portion 18.

The reservoir includes eighth portion 31 having an eighth interior surface 31' and an eighth exterior surface 32. The eighth exterior surface 32 faces a direction opposite the direction the eighth interior surface 31' faces. The eighth interior surface 31' delimits the hollow chamber 15 of the reservoir going in the direction away from of the second end 12*b* of the reservoir. It also delimits the hollow chamber 15 going in a direction away from the third end 12*c* of the reservoir. The eighth interior surface 31' and the eighth exterior surface 32, respectively, each completely lie in a single respective plane and are each planar. The eighth portion 31, eighth interior surface 31', and eighth exterior surface 32 are angled. The eighth interior surface 31' is angled relative to the first interior surface 20 at an angle greater than 90 degrees and less than 180 degrees when going in a counterclockwise direction and starting from the a line drawn along or parallel to the first interior surface 20. The angle is more preferably between 130 and 150 degrees. The preferred angle shown is 140 degrees. The eighth interior surface 31' is angled relative to the second interior surface 22 at an angle of less than 90 degrees when going in the clockwise direction and starting from a line drawn parallel to or along the second interior surface. The angle is more preferably between 30 and 50 degrees. The preferred angle shown is 40 degrees. The eighth interior surface 31' is angled relative to the first line perpendicular 25' at an angle of greater than 90 degrees and less than 180 degrees when going in the counterclockwise direction and starting from the eighth interior surface. The angle is more preferably between 120 and 140 degrees. The preferred angle shown is 130 degrees. The eighth interior surface 31' is angled relative to the second line perpendicular 37' at an angle of greater than 90 degrees and less than 180 degrees when going in the counterclockwise direction and starting from the second line perpendicular. The angle is more preferably between 130 and 150 degrees. The preferred angle shown is 140 degrees. The starting point when going in the above specified directions is always in the positive X direction. The vertex of the angle is the 0, 0 coordinates.

The eighth exterior surface 32 is angled relative to the first interior surface 20 at an angle greater than 90 degrees and less than 180 degrees when going in a counterclockwise direction and starting the line drawn parallel or along first interior surface. The angle is more preferably between 130 and 150 degrees. The preferred angle shown is 140 degrees. The eighth exterior surface 32 is angled relative to the second interior surface 22 at an angle less than 90 degrees when going in a clockwise direction and starting from the line drawn along or parallel to the second interior surface. The angle is more preferably between 30 and 50 degrees. The preferred angle shown is 40 degrees. The eighth exterior surface 32 is angled relative to the first line perpendicular 25' at an angle of greater than 90 degrees and less than 180 when going in a counterclockwise direction and starting from the eighth exterior surface 32. The angle is more preferably between 120 and 140 degrees. The preferred angle shown is 130 degrees; The eighth exterior surface 32 is angled relative to the second line perpendicular 37' at an angle of greater than 90 degrees and less than 180 degrees when going in a counterclockwise direction and starting from the second line perpendicular. The angle is more preferably between 130 and 150 degrees. The preferred angle shown is 140 degrees.

The eighth portion 31 is angled relative to the third portion 33 going in a counterclockwise direction and starting from a line drawn along the third interior surface 33' at less than 90 degrees. The angle is more preferably between 40 and 60 degrees. The preferred angle shown is 50 degrees. The eighth portion 31 is angled from the fourth portion 35 going in a clockwise direction from the fourth interior surface 35' at greater than 90 degrees and less than 180 degrees. The angle is more preferably between 120 and 140 degrees. The preferred angle shown is 130 degrees. The eighth portion 31 is angled relative to fifth portion 39 to form an interior angle greater than 180 degrees and less than 270 degrees. The angle is 230 degrees.

The eighth portion 31 has a first end at the fourth end 12*d* of the reservoir. The end contacts the fourth portion 35 at an end of the fourth portion 35, opposite where the second portion 18 contacts the fourth portion 35. A second end of the eighth portion is neither at the third end 12*c* or the first end 12*a* of the reservoir. This opposite end contacts an end of the fifth portion 39. The end of the fifth portion 39 contacted is the end opposite the end of the fifth portion 39 at the first end 12*a*.

The fifth portion 39 is angled relative to the first portion to form an interior angle of 90 degrees. Also the second portion 18 is angled relative to sixth portion 97 to form an interior angle of 90 degrees. The sixth portion 97 is angled relative to the seventh portion 100 to form an exterior angle of 90 degrees. The seventh portion 100 is angled relative to the third portion 33 to form an interior angle of 90 degrees. The term interior to describe the angles of the reservoir portions means the angle is in the hollow.

The reservoir has a first side portion 103 with a first side exterior surface 103" and interior surface 103'. The first side exterior surface 103" faces a direction opposite the direction the first side interior surface 103' faces. The first side interior surface 103' and the first side exterior surface 103", respectively, each completely lie in a single respective plane and are each planar. The first side portion 103 is at a first side of the reservoir. The first interior side surface 103' is at a first interior side 103'" of the reservoir. The first interior surface 103' at interior side 103'" delimits the hollow chamber 15 of the reservoir going from the chamber 15 in the direction towards the first side 12*e* of the reservoir. The first interior side surface 103' delimiting the hollow 15 is continuous. The first side portion 103 is coupled to and continuously joins reservoir portions one through eight 17, 18, 33, 35, 39, 97, 100, and 31 to one another. The joinder is at the first side 12*e* of the reservoir. The side portion 103 overlaps first side surfaces 17*a*, 18*a*, 33*a*, 35*a*, 39*a*, 97*a*, 100*a*, and 31*a* of the reservoir portions one through eight. Each of the first side surfaces of reservoir portions one through eight has a tab 105 extending therefrom. The first side portion 103 has openings 103*a* therein adapted and arranged near a perimeter of the side portion 103 to receive the tabs 105 of reservoir portions one through eight. The complimentary tabs 105 and openings 103*a* allow for aligning and locating the first side portion 103 with the first side surfaces of reservoir portions one through eight at the first side 12*e* of the reservoir.

The reservoir has a second side portion 107 with a second side exterior 107" surface and interior surface 107'. The second side exterior surface 107" faces a direction opposite the direction the first side interior surface 107' faces. The second side interior surface 107' and the second side exterior surface 107", respectively, each completely lie in a single respective plane and are each planar. The second side portion 107 is at a second side 12*f* of the reservoir. The second side interior surface 107' delimits a second interior side 107'" of the reservoir. The second interior side surface 107' at the second interior side 107'" delimits the hollow chamber 15 of the reservoir going from the chamber 15 in the direction towards the second side 12*f* of the reservoir. The second side interior surface 107' delimiting the hollow chamber 15 is continuous. The second side portion 107 is coupled to and continuously joins reservoir portions one through eight 17, 18, 33, 35, 39, 97, 100, and 31 to one another. The joinder is at the second side 12*f* of the reservoir. The second side portion 107 overlaps second side surfaces 17*b*, 18*b*, 33*b*, 39*b*, 97*b*, 100*b*, and 31*b* of reservoir portions one through eight. Each of the second side surfaces of reservoir portions one through eight has a tab 109 extending therefrom. The second side portion 107 has openings 111 therein adapted and arranged near a perimeter of the side portion 107 to receive the tabs 109 of reservoir portions one through eight. The complimentary tabs 109 and openings 111 allow for locating and aligning the second side portion 107 with second side surfaces of reservoir portions one through eight at the second side of the reservoir.

The first side portion 103 and its interior 103' and exterior 103" surface are, respectively, parallel to the second side portion 107 and its interior 107' and exterior 107" surfaces. The distance measured along a shortest straight line from the first interior side surface 103' to the second interior side surface 107" is the interior width of the reservoir 12. The width is less than the interior depth 37 and height 25. The distance measured along a shortest straight line from the first exterior side surface 103" to the second exterior side surface 107" is the exterior width of the reservoir. The exterior width is less than the exterior depth and height of the reservoir.

The first 103 and second 107 side portions are each a single, monolithic, seamless piece. Each piece 103, 107, when aligned with tabs 105, 109 overlaps first and second side surfaces of reservoir portions one through eight by 3.175 mm's. The overlap allows for a fillet weld to portions 1-8. Each piece 103, 107 is 14 gauge stainless steel and is considered sheet metal.

The first 103 and second 107 side portions each have mounting tabs 113 with openings at their perimeter. The tabs 113 with openings allow for mounting of the reservoir 12 to the frame 47. The openings are formed with threaded sleeves 113'. The first side portion 103 and the second side portion 107 could be coupled to reservoir portions one through eight without overlapping the side surfaces of reservoir portions one through eight. In this case the first 103 and second 107 sides would be overlapped by reservoir portions one through eight and the tabs 105, 109 and openings 103*a*, 111 would be reversed.

Reservoir portions one 17, four 35, five 39 and eight 31 and their respective interior surface, exterior surface and side surfaces are formed as a unitary piece. The piece 115 has a sheet like construction wherein the sheet has reservoir portions angled relative to one another as described above. Reservoir portions two 18, three 33, six 97 and seven 100 and their respective interior, exterior, and side surfaces are formed as a unitary piece. The piece 117 has a sheet like construction wherein the sheet has reservoir portions angled relative to one another as described above. The pieces 115 and 117 are each monolithic, singular, and are seamless. The pieces 115 and 117 are laser cut and are fillet welded to each other. Reservoir first portion 17 overlaps reservoir third portion 33 and reservoir second portion 18 overlaps reservoir fourth portion 35 by 3.175 mm's and each portion 17 and 33 has a complimentary tab and through opening locating system, tabs 105 and openings 103, to align pieces 115 and 117. Alternatively, piece 115 could be monolithic with second reservoir portion 18 as opposed to reservoir portion one 17 and piece 117 could be monolithic with first reservoir portion 17 as opposed to portion two 18. The pieces are made of 14 gauge stainless steel. The pieces are sheet metal.

A through opening 123 passes through the reservoir and opens onto the hollow chamber 15. Filter 81, which extends into the hollow chamber 15, is coupled to the reservoir proximate the through opening 123 and extends through the through opening 123. The through opening 123 extends through the second portion 18 and the second interior 22 and exterior surfaces 23. The filter 81 has a fluid inlet port 54" into which the fill entry 54' opens. The fill entry 54' is covered by fill entry closure 54. Hydraulic fluid, which has entered the filter 81 through inlet 54" or fill entry 54', exits the filter through fluid outlet port 81*a'*.

The inlet port 54" is coupled to a fitting 125*a*. The fitting forms part of a conduit 125 which receives hydraulic fluid from the heat exchanger 127 and directs the fluid into the filter 81. The conduit 125 is a low pressure return conduit. The heat exchanger 127 receives the hydraulic fluid from the control block 137 by way of conduit 202. The fitting 125*a* also forms part of a conduit 131 which receives fluid directly from the control block 137. The conduit 131 receives hydraulic fluid from the block 137 after the fluid has done work and directs it to the filter 81. The conduit 131 is a bypass conduit which allows the fluid after it has done work to bypass the heat exchanger 127. The filter 81 can also have an inlet 81*b* to receive hydraulic fluid after it has powered the hydraulic fan motor 159. In this case the inlet is coupled to a conduit 133 which includes a fitting. The conduit 133 receives hydraulic fluid from the fan motor 159 and directs it to the filter. Conduit 200 directs high pressure hydraulic fluid from the control block to the fan motor 159.

The inlets 54" and 81*b* are formed in a head 81*a'"* of the housing 81*a*. The outlet 81*a'* is formed in the bowl 81*a""* of the housing 81*a*. The housing 81*a* has a long axis. The long axis extends through the filter outlet port 81*a'*. The outlet 81*a'* is within the hollow chamber 15 of the reservoir.

The filter 81 is coupled to the reservoir by fasteners 82. The head 81*a'"* is coupled to the reservoir at the second exterior surface 23 by fasteners 82. The fasteners include lugs which extend away from the second exterior surface 23 through openings in the head. A gasket between the head and the second exterior surface helps seal the filter 81 to the reservoir 12. The head forms the fill entry 54'. The movable closure 54, in a closed position, covers the fill entry 54' and in an open position uncovers, at least partially, the fill entry 54'. The closure 54 is a removable cap. When the closure is in the open position, removed, an operator fills the reservoir 12 by transmitting hydraulic fluid through the fill entry 54'. The head 81*a'"* also has pressure relief vents, not shown, which allow the reservoir 12 to vent pressure, especially when being filled with hydraulic fluid.

A through opening 141 extends through the reservoir 12 and opens into the hollow chamber 15 proximate the interior bottom of the reservoir. The through opening 141 has a fitting 141*a* installed therein that receives a drain plug 141' installed therein. The through opening extends through the third portion 33 and its interior and exterior surfaces.

A conduit, not shown, is fluidly coupled to the reservoir by its fitting. The conduit couples to a pump. The pump draws the fluid out of the reservoir through the conduit coupled to one of the fittings 71, 75 of its respective suction port 72, 77. When the port is not going to be used in connection with a particular truck installation it is covered by a plug 80.

The frame 47 has a depth, width and height, respectively, oriented along the same directions as the interior depth, interior width and interior height of the reservoir. The frame 47 has a front, rear, first side, second side, top and bottom, respectively, oriented along the same directions as the front, rear, first side, second side, top, and bottom of the reservoir. The frame's front, rear, first side, second side, top and bottom, respectively, are oriented along the same directions as the front, rear, first side, second side, top, and bottom of the cooling assembly. The bottom, top, rear, and front sides of the frame are respectively at the first end 47*a*, second end 47*b*, third end 47*c*, and fourth end 47*d* of the frame 47.

A first portion 48 of the frame 47 has a first interior 48*a* and exterior 48*b* surface, respectively, at an interior and exterior side of the first portion 48. The first exterior 48*a* and interior 48*b* surfaces are planar. The first portion 48 is made of sheet metal. An air port 48*c*, circumscribed at its perimeter by a fan ring 49 at the interior side, extends through the first portion 48 and its exterior and interior surface. The ring 49 can be alternatively called a collar. The first portion 48 is at the bottom of the frame 47 and at the first end 47*a* of the frame; the first exterior surface 48*b* delimits an exterior bottom and exterior first end 47*a* of the frame 47; the first interior surface 48*a* delimits an interior bottom and first interior end of the frame. The first portion 48 has a fourth end 48*d* with a fourth end surface 48*d*', a third end 48*e* with a third end surface 48*e*', a first end 48*f* with a first end surface, and a second end 48*g* with a second end surface, respectively, at the fourth end 47*d*, the third end 47*c*, first side 47*e*, and second side 47*f* of the frame 47. A first border member 147 at the fourth end 48*d* extends from the first end 48*f* to the second end 48*g* of the first portion 48 and away from the first interior surface 48*a*. The border member 147 is integral and seamless with the first portion 48. The first border member 147 is a portion of portion 48 and is bent upwards to extend away from the first interior surface 48*a*.

A second border member 148 extends away from the fourth end 48*d* towards the third end 48*e* of the first portion 48. It extends to the third end 48*e* from the fourth end 48*d*. It extends at the first end 48*f* of the first portion 48 away from the first interior surface 48*a*. It overlaps the first end surface of the first frame portion 48. A third border member 149 extends away from the fourth end 48*d* towards the third end 48*e* of the first portion 48. It extends to the third end 48*e* and from the fourth end 48*d*. It extends at the second end 48*g* of the first portion 48 and away from the first interior surface 48*a*. It overlaps the second end surface of the first frame portion. Extending in a direction away from the first portion 48 and towards the second end 47*b* of the frame is second frame portion 59 which is a first upright. The first upright 59 is closer to the frame's third end 47*c* and first side 47*e* than it is, respectively, to the frames fourth end 47*d* and second side 47*f* Extending in a direction away from the first portion 48 and towards the second end 47*b* of the frame 47 is third frame portion 61 which is a second upright. The second upright 61 is closer to the frame's third end 47*c* and second side 47*f* than it is, respectively, to the frame's fourth end 47*d* and first side 47*e*. The uprights 59 and 61 are opposite each other. Each upright 59 and 61 is coupled to the first frame portion 48.

Both the first 59 and second 61 uprights are located the same distance from the first portion fourth end 48*d* towards the first portion third end 48*e*. Each upright is about ⅝ of the distance to the third end surface 48*e*' of the first portion 48. The uprights 59, 61 are near a line extending from the first end 48*f* to the second end 48*g* of the first portion. The line is tangent a point on the ring 49 closest the third end 48*e* of the first portion 48. Both the first and second uprights 59, 61 each have mounting areas 59*a*, 61*a* with openings therein. The areas 59*a*, 61*a* receive fasteners which couple to the mount tabs and extend into the sleeves 113', on the reservoir first 103 and second 107 side portions. The fasteners couple the reservoir 12 to the frame 47 at the uprights 59, 61. The open areas 58, 60 described above are formed in uprights 59, 61.

The first upright 59 and the second border 148 are a unitary, single, monolithic, seamless piece forming an L shape. The second upright 61 and the third border 149 are a unitary, single, monolithic, seamless piece forming an L shape.

Each upright 59, 61 has an end 59*b*, 61*b* opposite the first portion 48. These ends, opposite the frame first end 47*a*, are at the second end 47*b* of the frame. A cross member 151, which is a flat rectangular sheet metal piece, extends away from the first upright 59 to the second upright 61. The cross member 151 contacts each upright at opposite ends of the cross member 151. The cross member is proximate ends 59*b*, 61*b*. The cross member 151 has a planar exterior surface 151*a* which faces away from the first portion 48 first interior side 48*a*.

A mounting member 153 is coupled to the uprights 59, 61. The mounting member 153 is a mounting plate. The member 153 has an exterior 153*b* and interior 153*a* surface, respectively, at an exterior and interior side of the mounting member 153. The interior 153*a* and exterior 153*b* surfaces are planar. The exterior surface 153*b* faces away from the frame fourth end 47*d* and the interior surface 153*a* faces towards the frame fourth end 47*d*. The mounting member 153 is perpendicular to the first portion 48. The mounting member 153 is where the frame 47 is coupled to a frame rail 157 of a truck. The mounting member 153 has though openings 153*c* which extend though the member 153 and its exterior and interior surfaces 153*a*, 153*b*. The through openings 153*c* receive coupling hardware, not shown, which couples the frame 47 to the frame rail 157. When the frame 47 is coupled to the frame rail 157, the mounting exterior surface 153*b* faces an outward facing surface 157*b* of the frame rail. The surface 157*b* extends in a direction along a line extending from the top of the rail to a bottom of the rail. The surface also extends in the direction of the long axis of the frame rail 157. The term outward, as used in connection with the frame rail 157, means a direction facing away from an inward end of the rail and facing away from a central area delimited by the truck's frame rails, one of which is shown as 157. The mounting member 153, as explained more fully below, allows for the frame 47 and assembly to be coupled to the frame rail 157 with a particular orientation relative to the frame rail 157.

The frame 47 includes a control block mount 140. The control block mount 140 has a first surface 140*a*, on a first side, facing the frame first end 47*a*. The mount has a second surface 140*b*, on a second side, facing the frame second end 47*b*. The first and second surfaces are parallel to the first portion 48 of the frame 47. The control block 137 is coupled to the control block mount 140 and mounted to the mount 140 on the first side of the mount. The first surface 140*a* faces the control block. The second surface 140*b* faces away from the control block. The control block has a side with a surface 137*b* that faces away from the frame fourth end 47*d*. The surface has a high pressure port 137*b*' and a return port 137*b*". The high pressure port connects to a portion of a conduit such as its "T" fitting 138. High pressure fluid used to power a hydraulic fan motor 159 of the assembly is directed to and into the block 137 through the conduit including its fitting 138. The return port 137*b*", low pressure port, connects to a portion of a conduit such as its fitting 139. Low pressure hydraulic fluid to be cooled by the heat exchanger 127 of the assembly, after it has performed work, is directed to and in into the block through the conduit including its fitting 139. The control block 137 can include an auxiliary port 143 to couple to an auxiliary device, such as a pressure gauge, to the control block. The control block can further include another port to couple to a pressure relief valve.

The frame 47 includes a fan motor mount 161. The fan motor mount 161 has portions 161*a*, 161*b*, legs, which extend in a direction away from the frame first end 47*a* towards the frame second end 47*b*. The legs 161*a*, 161 *b* extend away from the first portion interior surface 48*a*. The legs are couple to the first portion 48. A first pair of first legs 161*a* and a second pair of second leg 161*b* are about the air port 48*c*. The pairs are at opposite sides of the air port 48*c*. The fan motor mount 161 has a portion 161*c* which extends from the first pair of legs to the second pair of legs. The portion 161*c*, which is a cross member, overlaps and spans across the air port 48*c*. The cross member 161*c* is coupled to the legs. The portion 161*c* has a first surface 161*c*' facing away from the frame first end 47*a* and in the direction of the frame second end 47*b*. The portion 161*c* has a second surface facing away from the frame second end 47*b* towards the frame first end 47*a*. The cross member, portion 161*c*, can have fasteners such as threaded lugs 162, extending in a direction away from the first surface 161*c*' and away from the first end 47*a* of the frame 47. The lugs 162 couple the fan motor 159 to the mount 161. The cross member 161*c* defines an opening 161*d* through which a shaft coupled to the fan motor 159 extends when the motor 159 is coupled to the mount 161. Once the motor 159 is coupled to the mount 161, the fan 163, having a plurality of blades, is coupled to the shaft. The fan 163, when coupled to the shaft of the motor, and the motor 159 is coupled to the mount 161, is oriented to have a portion of the fan's blades circumscribed by the fan ring 49. The fan's 163 blades overlap the air port 48*c*. The frame is made of 14 gauge sheet metal.

A fan cover 164, which is a fan grate, is coupled to the frame 47 to overlap the air port 48*c* and the fan's 163 blades. The fan cover 164 is at the first exterior side of the first portion 48 and first end 47*a* of the frame. It is coupled to the first portion 48 at the first exterior surface 48*b*.

The frame 47 carries the heat exchanger 127. The heat exchanger 127 is coupled to the frame 47. It is couple to the first portion 48 at the first portion 48 interior side. Rotation of the fan 163 draws air into air chamber 166 through the port 48*c*. Air is drawn in from the environment. The air drawn into air chamber 166 through port 48*c*, now tasked as an inlet port, exits the air chamber 166 by passing through the heat exchanger 127. The air, to pass through the heat exchanger 127, first enters the heat exchanger by entering open passages at the heat exchanger second side 127*b*. The heat exchanger 127 has a first side 127*a*, opposite the second side 127*b*. Air entering the open passages at the second side 127*b* from the air chamber 166, exits the heat exchanger 127 and open passages at the heat exchanger first side 127*a*. The air exiting the heat exchanger exits into the environment. Angled exterior surface 32 of the eighth reservoir portion 31 deflects at least some of the air drawn into the air box before it is exhausted through the heat exchanger 127. The passing of the air through the heat exchanger cools the hydraulic fluid passing through the heat exchanger. A first surface 127*a*' at the first side 127*a* and a second surface 127*b*' at the second side 127*b*, border the open passages. Surfaces 127*b*' and 127*a*' have been simplified for ease of discussion. A surface 127*b*", on the second side 127*b*, is about the second surface 127*b*' and delimits the air chamber 166 in a first horizontal direction 400 going from the air chamber 166 towards the frame fourth end 47*d*. The air chamber 166 is within an air box. The fan motor 159 is in the air chamber 166. The air inlet port 48*c* opens into the air chamber from the environment.

As an alternative to the above described air-flow, rotation of fan 163 could draw air from the environment into air chamber 166 through heat exchanger 127 and exhaust the air through port 48*c*. The air drawn into the air chamber 166 would first pass from the environment into the heat exchanger open passages at first side 127*a*. The air entering the heat exchanger at the first side 127*a* would exit the heat exchanger 127 and its open passages at the second side 127*b*. The air then enters the air chamber 166. The air would be exhausted into the environment from the air chamber 166 through port 48*c*, now an exhaust port. Air would be deflected by angled exterior surface 32.

Figure 7A:
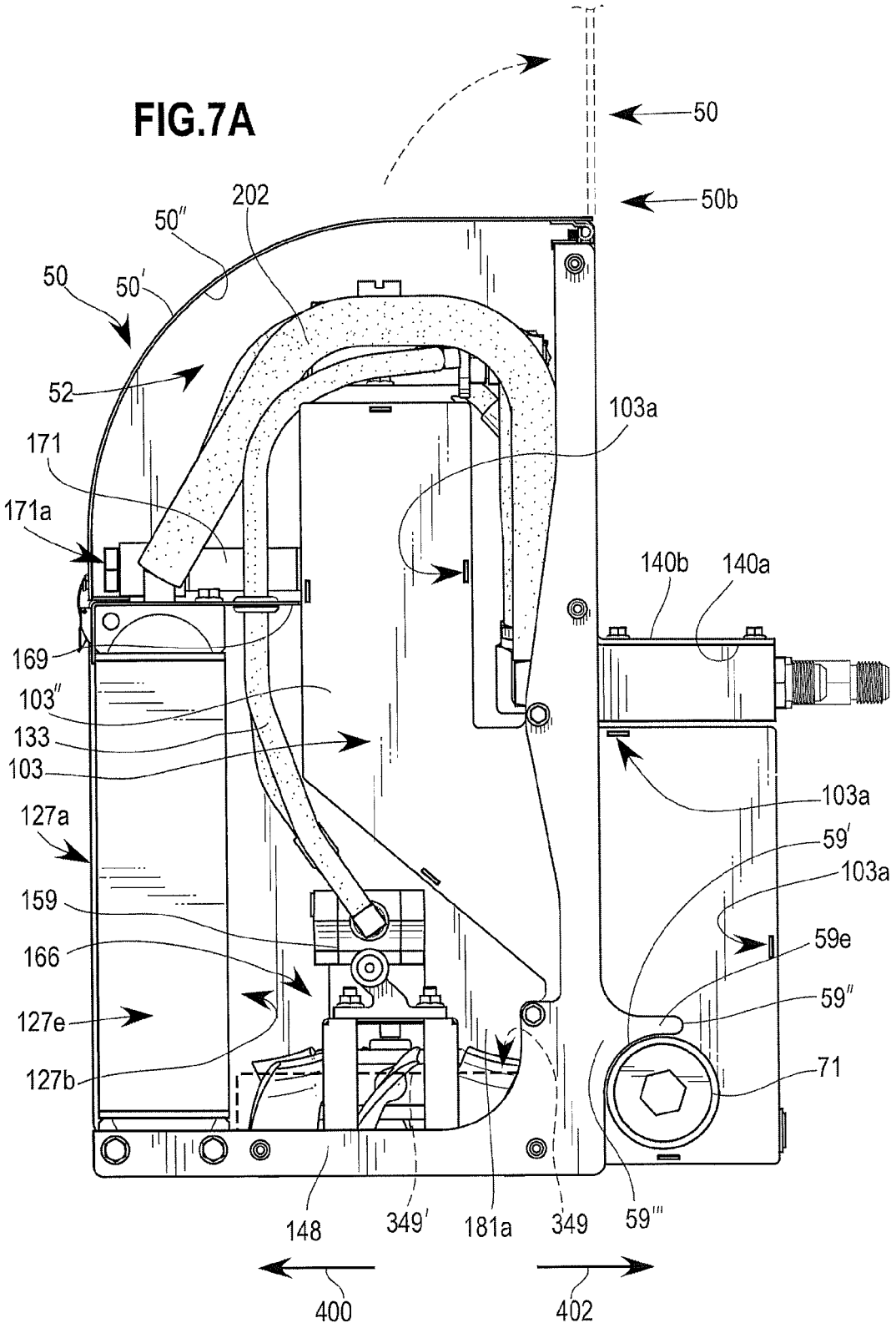
FIG. 7A is a right sided view of the assembly of FIG. 1 with the assembly first side panel removed.
Figure 7B:
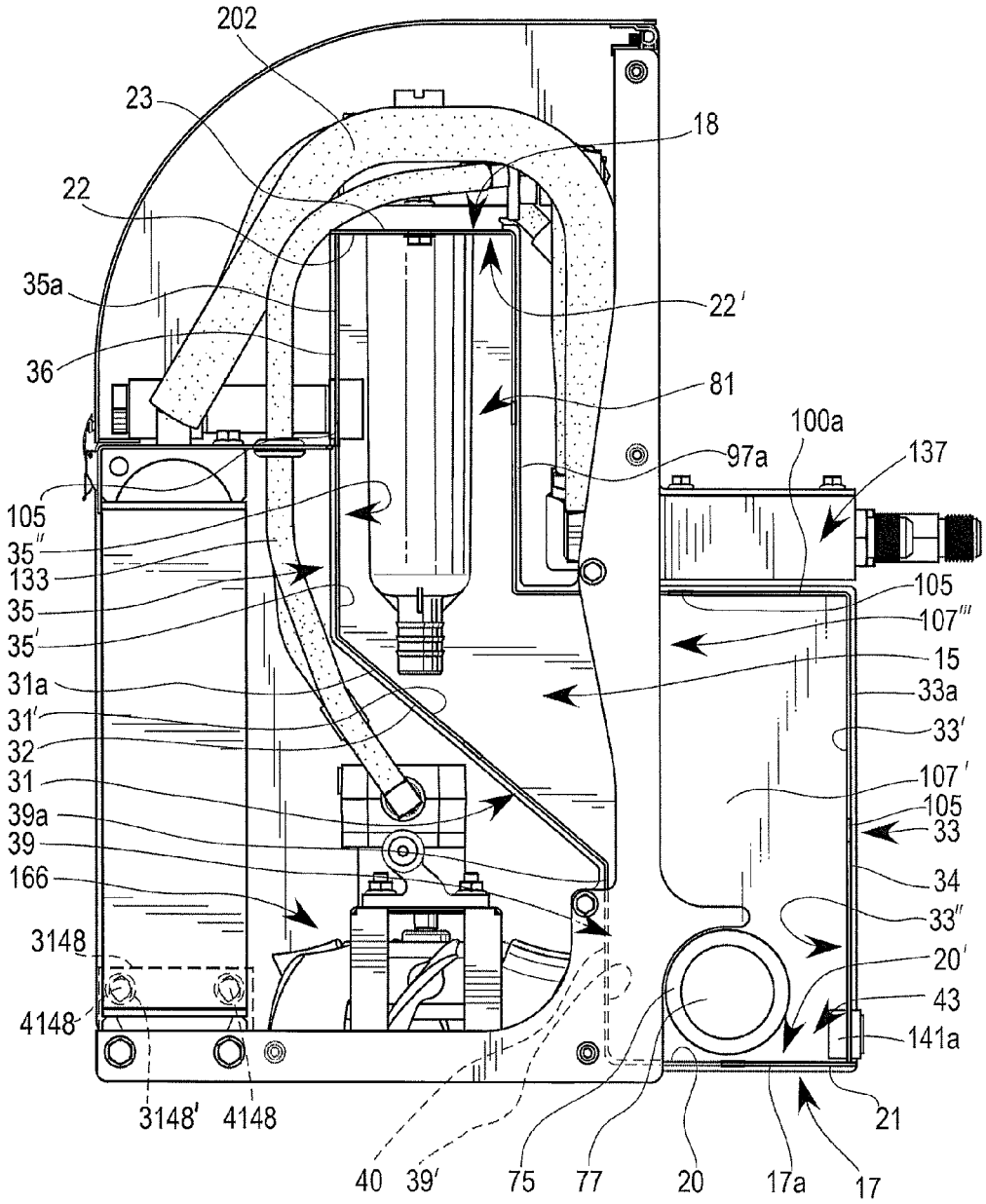
FIG. 7B is a right sided view of the assembly of FIG. 1 with the assembly first side panel and the reservoir first side portion removed; the plug for the suction port in the shown side portion has been removed.
Figure 7C:
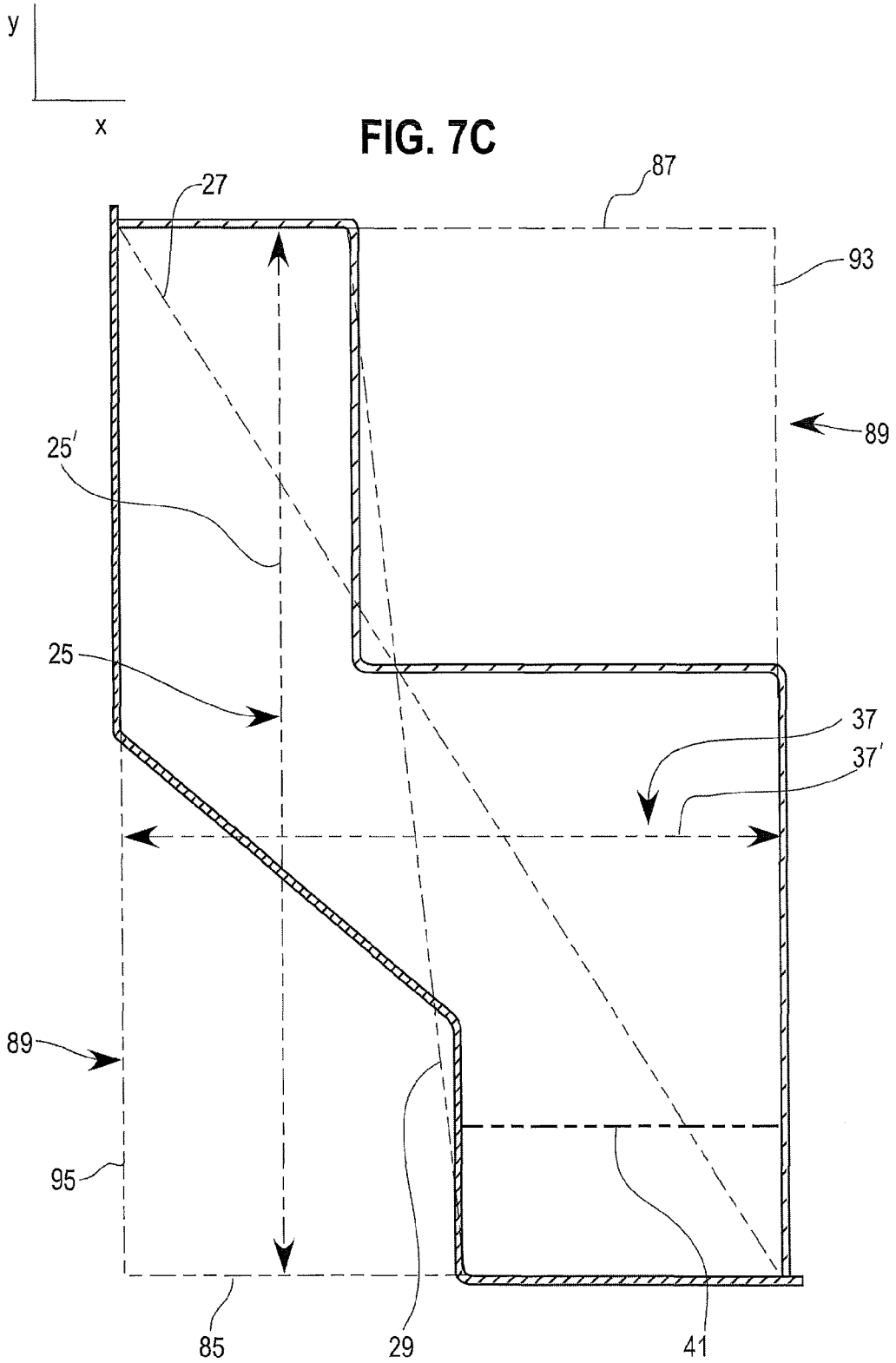
FIG. 7C is a blown-up sectional view of the assembly reservoir shown in FIG. 7B exclusive of the reservoir first and second side portions.
Figure 8A:
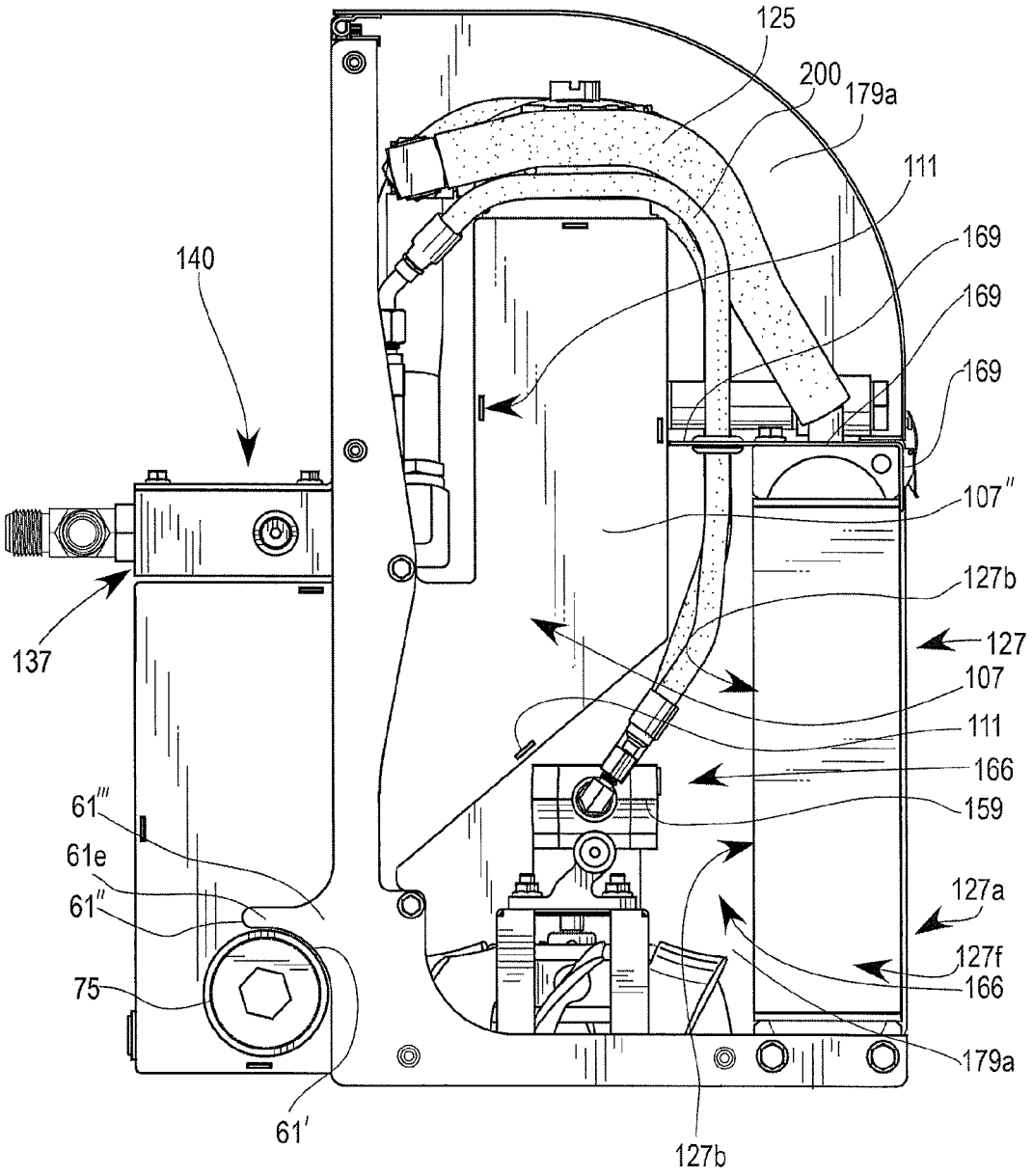
FIG. 8A is a left sided view of the assembly of FIG. 1 with the assembly second side panel removed.
Figure 8B:
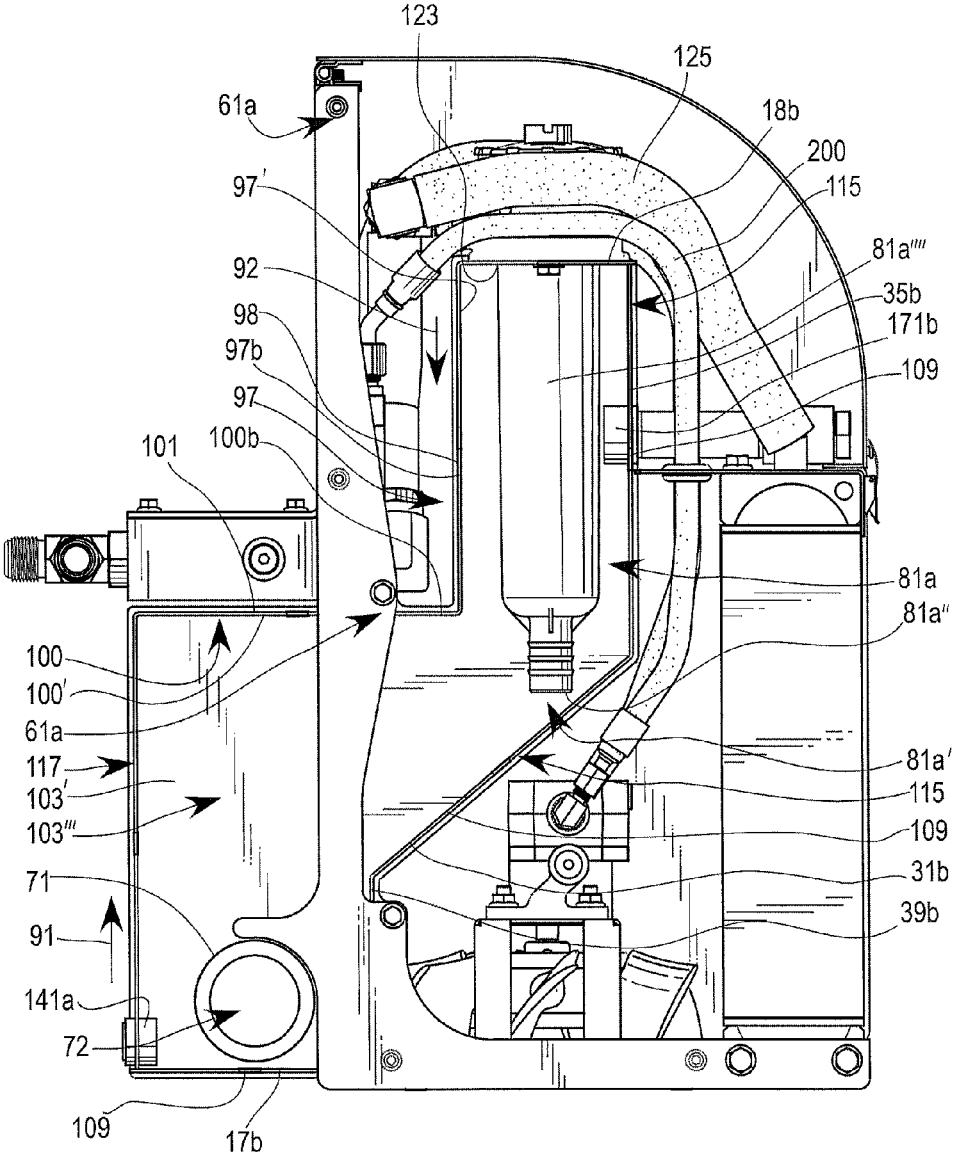
FIG. 8B is a left sided view of the assembly of FIG. 1 with the assembly second side panel removed and the reservoir second side portion removed; the plug for the suction port in the shown side portion has been removed.
Figure 9A:
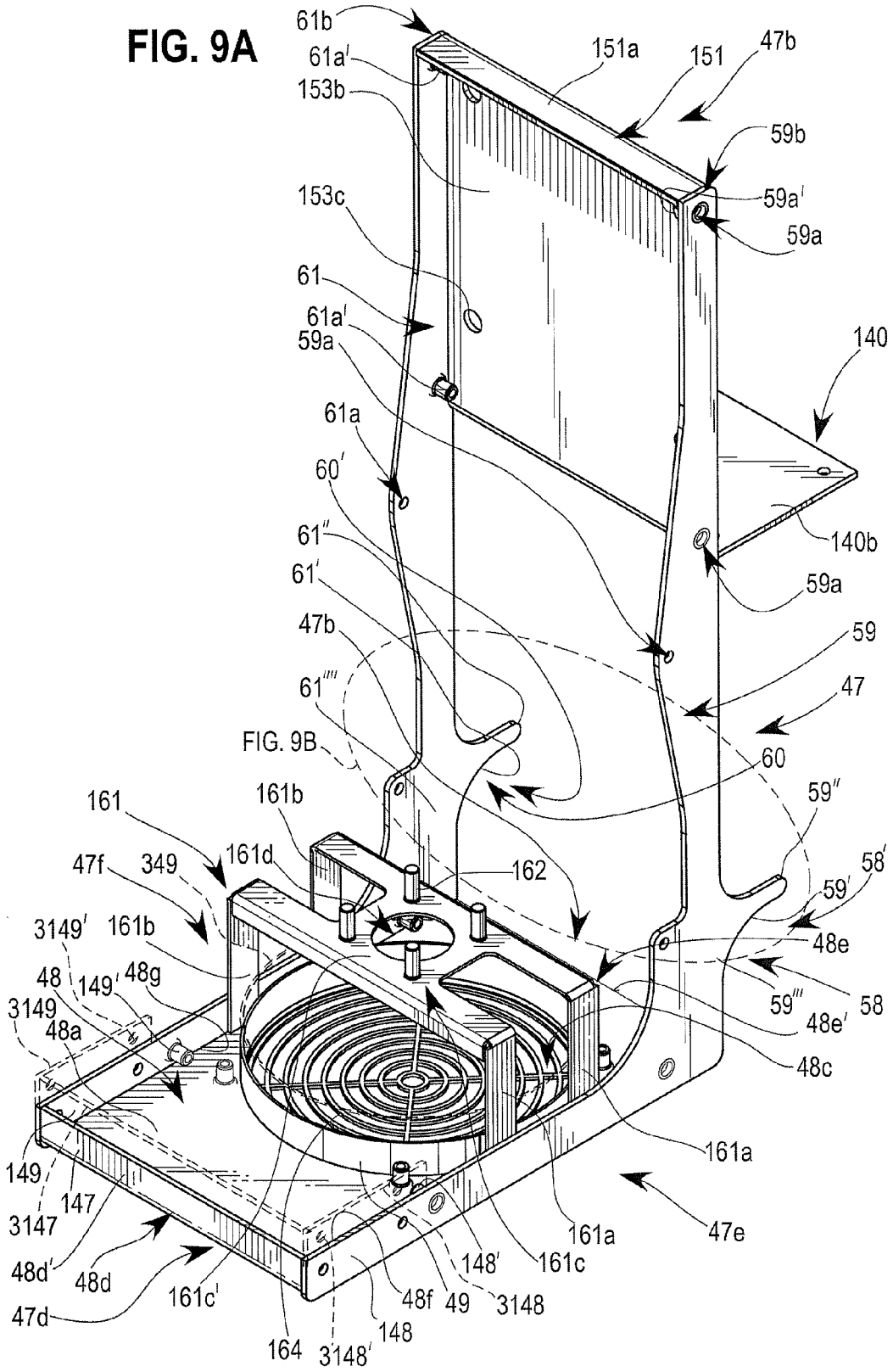
FIG. 9A is an isometric view of the frame of the mobile hydraulic cooling assembly of FIG. 1 carrying the fan cover, and exclusive of other components of the cooling assembly.
Figure 9B:
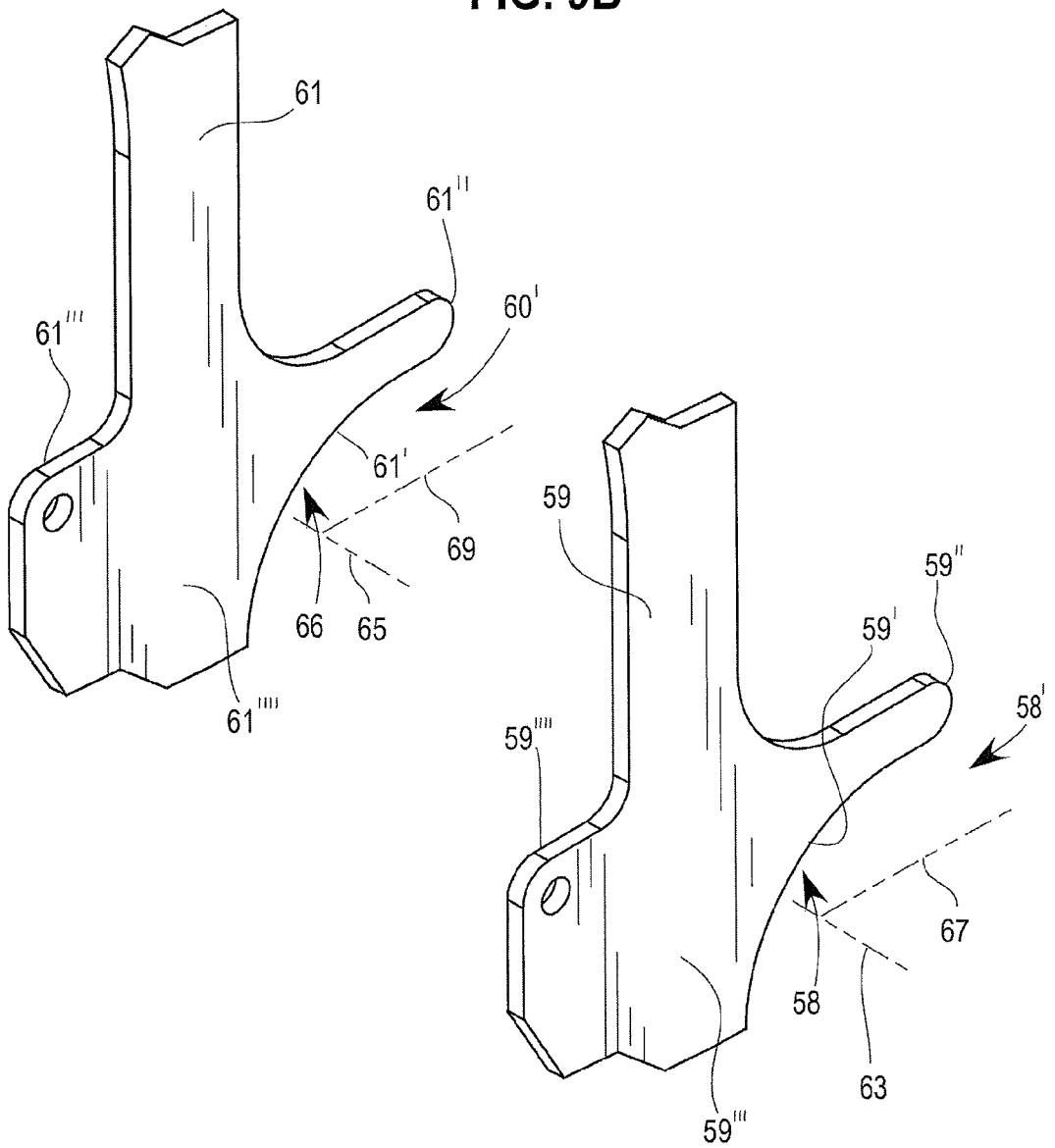
FIG. 9B is a blown-up isometric view of the detail area of the frame uprights shown in FIG. 9A.
Figure 10:
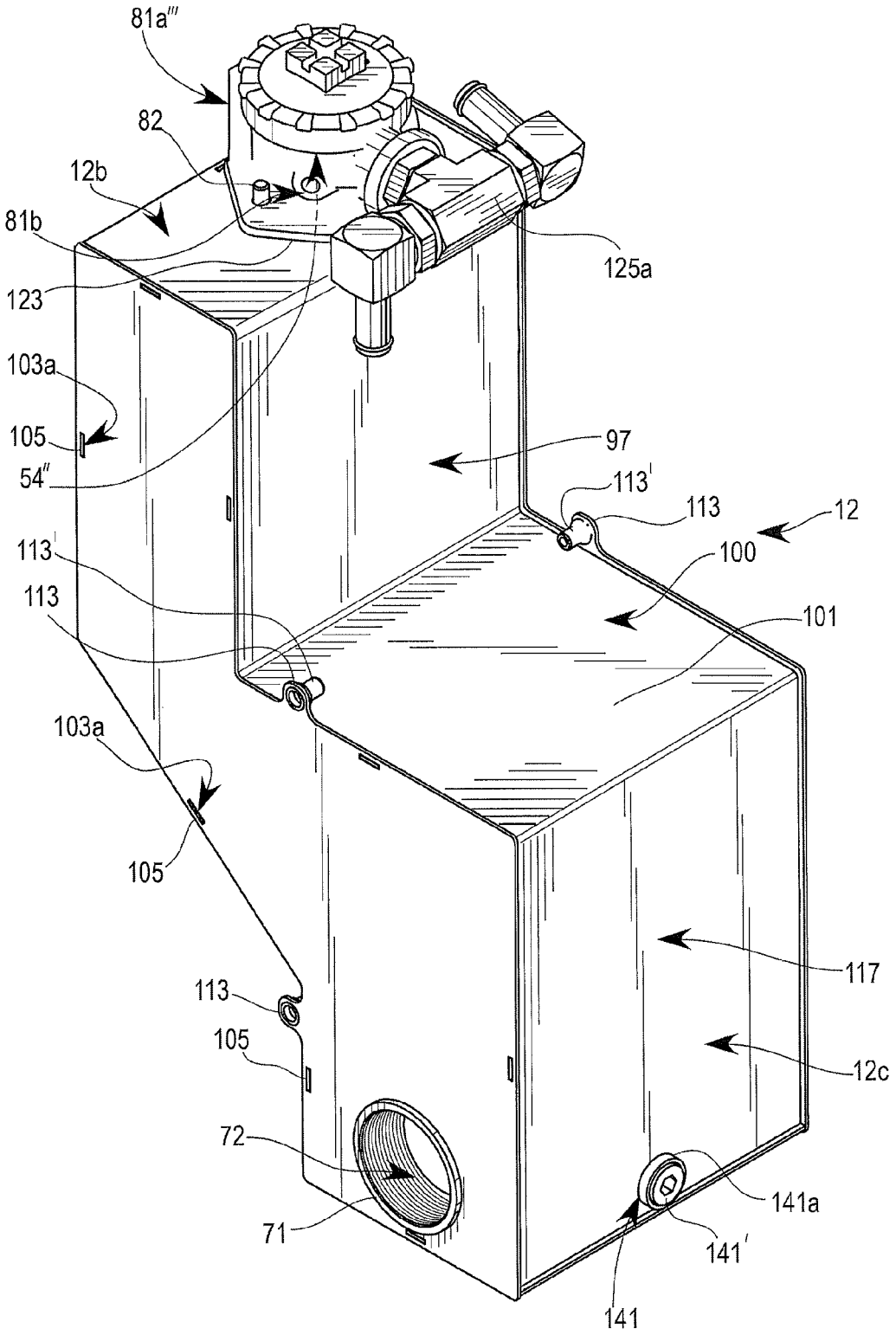
FIG. 10 is an isometric view of the reservoir of the mobile hydraulic cooling assembly of FIG. 1 carrying the filter; the reservoir has been removed from the rest of the assembly and the plug from the shown suction port has been removed.
Figure 11:
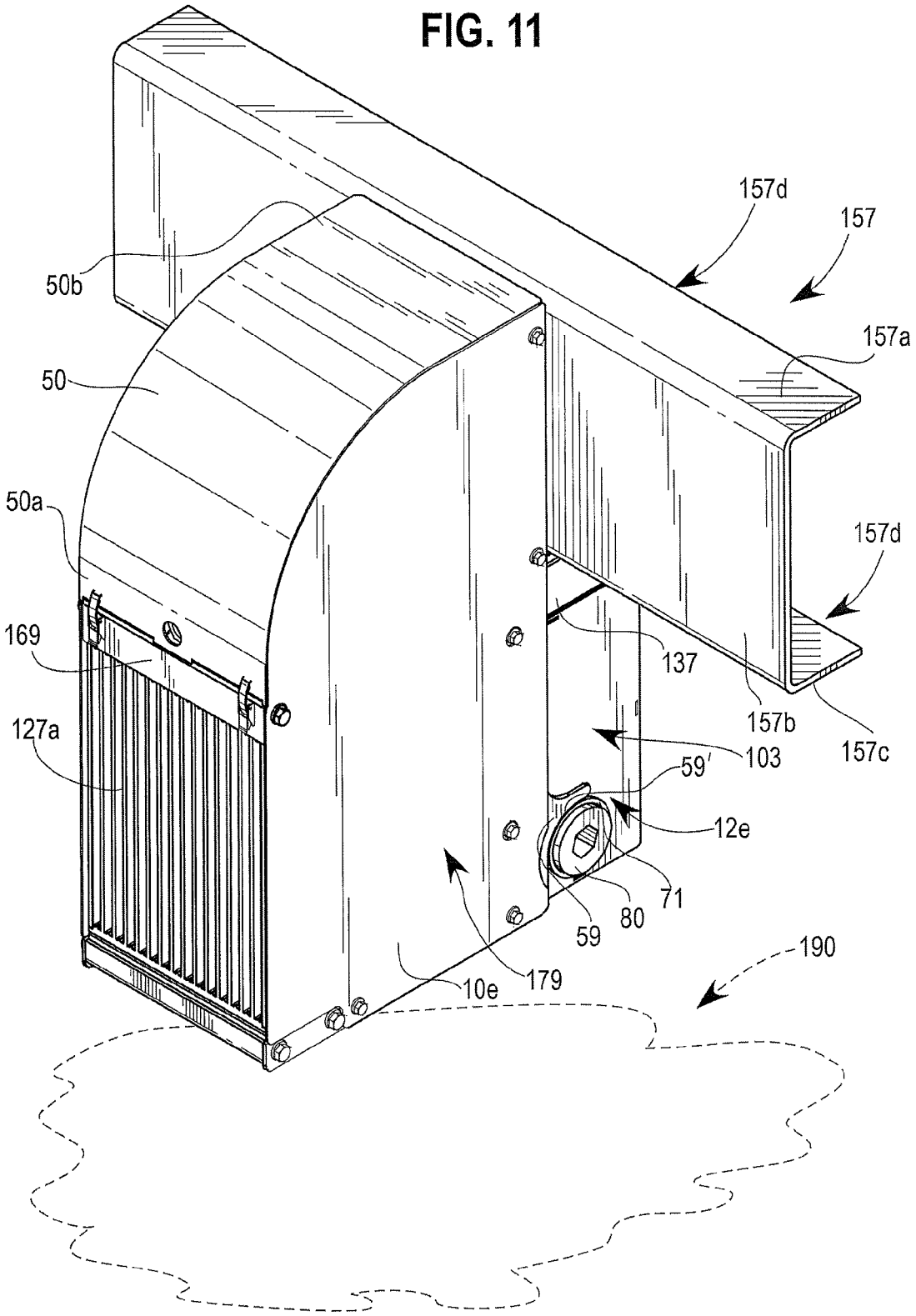
FIG. 11 is a schematic view of the hydraulic cooling assembly of FIG. 1 coupled to a truck frame rail.
Figure 12A:
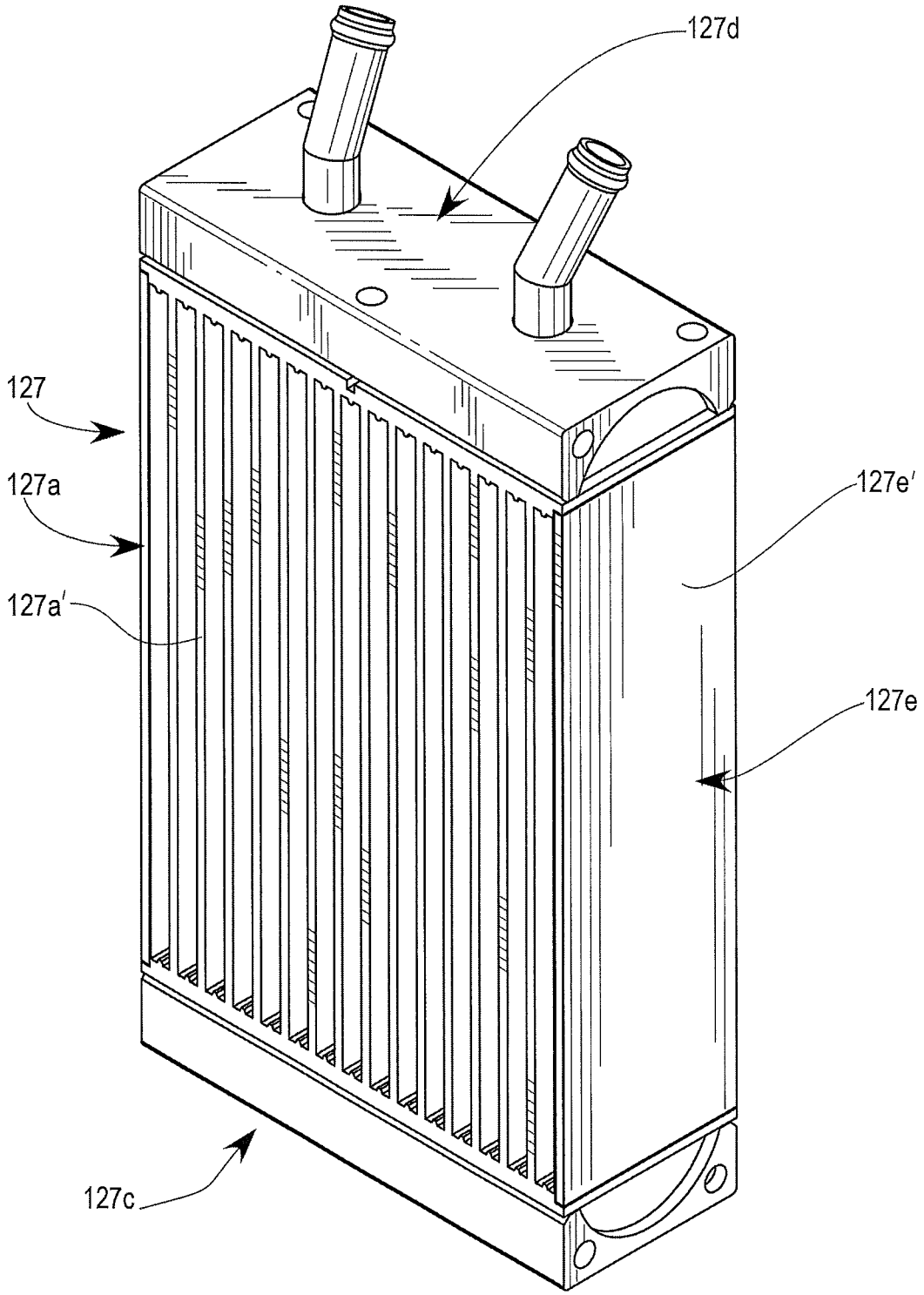
FIG. 12A is an isometric right sided front view of the heat exchanger of FIG. 3.
Figure 12B:
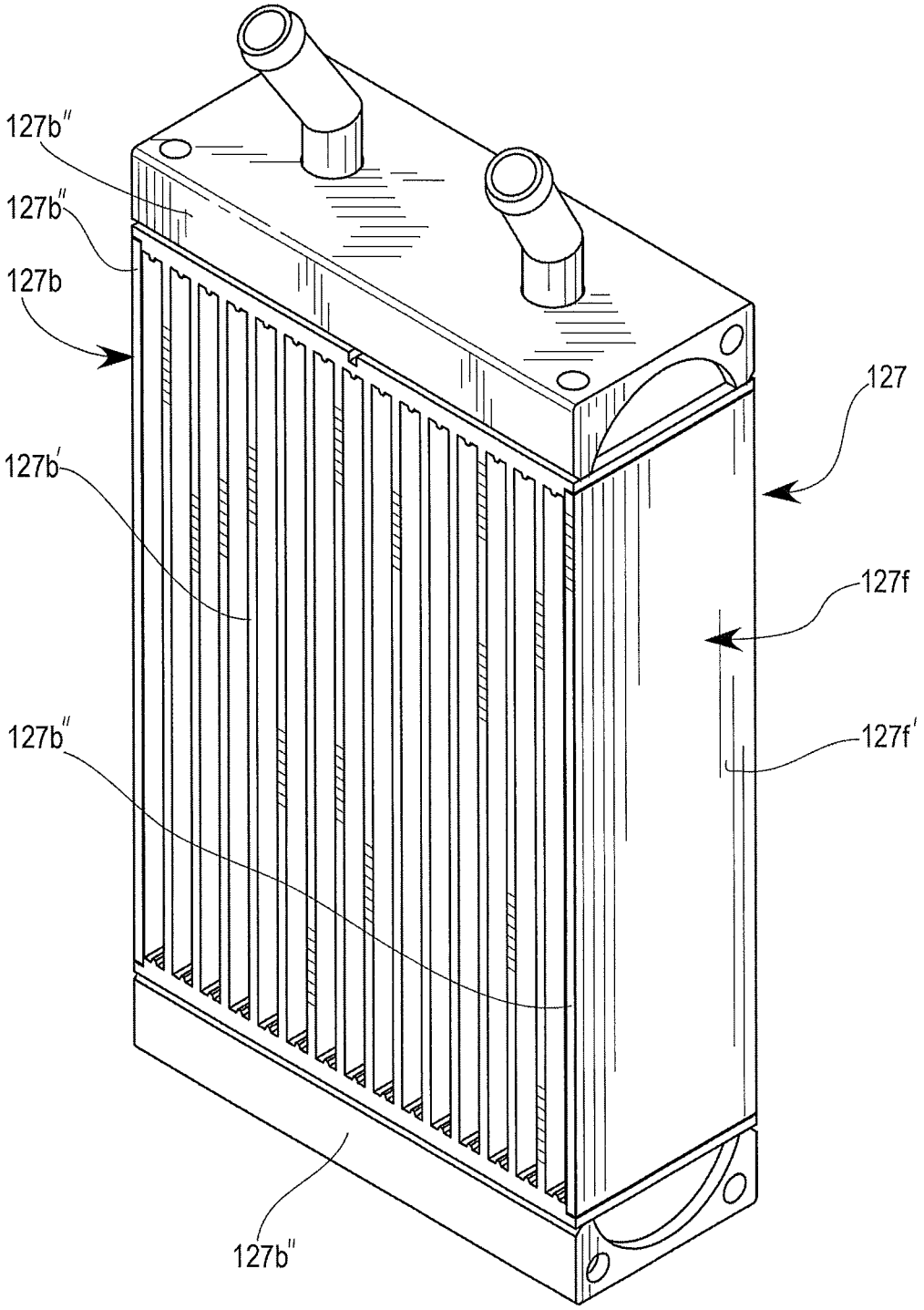
FIG. 12B is an opposite side isometric rear view of the heat exchanger of FIG. 12A.

For configurations in which air flow is drawn into air chamber 166 through the heat exchanger 127 by fan 163, a fan ring with a vertical length (height) greater than fan ring 49 can be used. The vertical height/length is measured in direction 91 from the frame first end 47*a* to the frame second end 47*b*. Increasing the vertical height of the fan ring 49 from 2.90 cm to a height of 8.65 cm provides for the upper edge 349' of the fan ring 349 to be of even height with the leading edge of fan blades. The fan ring with the increased vertical height is preferred when drawing air into the air-chamber 166 through heat exchanger 127. The fan ring upper edge 349' is shown in dotted line in FIGS. 7A, 7B, 9B. The upper edge 349' is closer to frame end 47*b* than the upper edge of fan ring 49. The fan ring 349 with greater height encompasses more of the fan in the vertical direction. If a fan ring of increased height were used, one would modify the construction in a manner well within the skill in the art. For instance the heat exchanger 127 would be raised away from the frame first end 47*a* towards the frame second end. To raise the heat exchanger, the vertical height of the second border member 148 at an end of the second border member 148 towards frame fourth end 47*d* would be increased, and the vertical height of the third border member 149 at an end of the member 149 towards frame fourth end 47*d* would be increased. The area of increased vertical height, if the second border member were so modified, is shown in dotted lines at 3148, and the area of increased vertical height, if the third border member were so modified, is shown in dotted lines 3149. The vertical height of the mounting holes 3148' in the area of the raised border member 3148 area would also be increased from where they are in the un-raised area of border member 148. The vertical height of the mounting holes 3149' in the area of the raised border member 3149 would also be increased from where they are in the un-raised area of border member 149. The mounting holes 3148', 3149' receive fasteners 4148 to couple the frame to the heat exchanger 127. The raised members 3148, 3149 and their respective mounting holes 3148', and 3149' would be configured to raise the heat exchanger 20-25 cm. Also the vertical height of the first border member 147 would be increased. The upper edge of a first border member 147, with an increased vertical height, is shown with dotted lined 3147. The sight glass 171 would be raised and enter the reservoir at a greater vertical height from first portion 17. The construction, such as the curvature, and length of the closure 50 would change to accommodate the raised heat exchanger and sight glass. The dotted lines, referenced in this paragraph, for convenience have been only included in certain figures and intentionally omitted from various figures.

The heat exchanger 127 has a first 127*c* and a second 127*d* end. The first end 127*c* is oriented, relative to the second end 127*d*, closer towards the frame first portion 48 than the second end 127*d* and the exchanger second end 127*d* is oriented, relative to its first end 127*c*, closer towards the frame second end 47*b* than the exchanger first side 127*c*. The heat exchanger has a third side 127*e* with a third side surface 127*e*' and a fourth side 127*f* with a fourth side surface 127*f*'. The third side 127*e* is oriented, relative to the fourth side 127*f*, towards the frame first side 47*e* and the exchanger fourth side 127*f* is oriented, relative to is third side, towards the frame second side 47*f*. The first end 127*c*, of the heat exchanger and portions of the third 127*e* and fourth 127*f* sides are in a space delimited by the first 147, second 148 and third 149 border members.

A wall member 169 overlaps the heat exchanger 127 at the exchanger first side 127*a* and second end 127*d*. It at least partially covers the second end 127*d*. The wall member 169 is coupled to the heat exchanger 169. A portion of the wall member 169 extends away from the heat exchanger first 127*a* and second 127*b* sides and towards the frame third end 47*b*. The portion of the wall member 169 extending delimits the air chamber 166 in vertical direction 91 from the air chamber 166 towards the frame second end 47*b*. A sight glass 171 is mounted to the wall member 169. An end 171*b* of the sight glass 171, opposite an end 171*a* through which an operator looks into to determine hydraulic fluid level in the reservoir, extends into the reservoir hollow chamber 15 and into and through an aperture in the reservoir. The aperture is through the reservoir fourth portion 35 and its exterior and interior surface.

The cooling assembly closure 50 carried by the frame 47 has an exterior surface 50". The closure 50 has a second end 50*b* which forms part of the top of the assembly. The closure second end 50*b* is at the second end 47*b* of the frame and couples to the frame 47 at the second end 47*b*. The closure second end 50*b* is hingedly coupled to the frame second end 47*b*. The hinges 173 are mounted on the cross member 151 of the frame. The closure 50 has a first end 50*a* which forms part of the fourth end 10*a* of the assembly and is at the fourth end 47*a* of the frame. Adjustable latches 175 on the wall member 169 allow for coupling of the closure first end 50*a* at the fourth end of the assembly and frame. The latches 175 are mounted to the portion of the wall member 169 overlapping the heat exchanger first side 127*a*. The catch to which the latch couples is mounted at the first end 50*a* of the closure 50. The closure continuously extends from its first end 50*a* to its second end 50*b*. The closure interior surface 50' and exterior surface 50' are curved going in the direction from the first end 50*a* to the second end 50*b*.

Disposed in the open area 52 are the fill entry closure 54, the reservoir second portion 18, a portion of the reservoir fourth portion 35, the fitting of conduit 131 into the control block 137, and the sight glass 171. When the closure 50 is in the open position, the open area 52 in which the fill entry closure 54, the fitting of conduit 131 into the control block, the reservoir second portion 18, the portion of the reservoir fourth portion 35, and the sight glass 171 are disposed, is open to the environment exterior to the closure 50. When the closure is in the open position, the open area 52 and the closure 54 of the fill entry 54' are accessible by the hands of an operator. The open area 52, when the closure 50 is in the closed position, is relatively closed off form the environment exterior. The operator opens the closure to the open position from the closed position by uncoupling the latches 175 from catches. The closure is than pivoted to move its first end 50 away from the frame first end 47*a*.

The frame 47 carries first and second side members which are panels 179, 181. The first and second side panels 179, 181 each have exterior 179*b*, 181*b* and interior 179*a*, 181*a* surfaces. The first panel 179 is at the first side 47*a* of the frame 47 and the first side 10*a* of the assembly. The second panel 181 is at the second side 47*b* of the frame 47 and a second side 47*b* of the assembly. The first side interior surface 179*a* delimits a side of the air chamber 166 going in a direction from the air chamber 166 to the assembly's first side 10*a*. The second side interior surface 181*a* delimits the air chamber 166 going in a direction from the air chamber 166 to the assembly's second side 10*b*. Each first and second side 179, 181 is coupled to the frame 47.

The first and second side 181 panels each have first 179*c*, 181*c* and second 179*d*, 181*d* ends. The first ends 179*c*, 181*c* are at the first end 47*a* the frame. The second ends 179*d*, 181*d* are opposite the first end 47*a* of the frame 47. At least a portion of the closure 50 spans an area between the first 179 and second side 181 panels. The closure 50 overlaps the second ends 179*d*, 181 *d* of the side panels 179, 181. The first side panel 179 has openings 179*e* which receive fasteners that extend into the openings in mount areas 59*a* of upright 59; and openings 179*e* which receive fasteners that extend in openings of second border member 148. The openings in the mount areas 59*a* that do not align with tabs 113 of reservoir 12 are formed with threaded sleeves 59*a*' which receive the fasteners. The openings in second border 148 which fasten to the side panel 179 are formed with sleeves 148' that receive the fasteners. The second side panel 181 has openings 181*e* which receive fasteners that extend into openings in mount areas 61*a* of upright 61 and openings 181*e* which receive fasteners that extend into openings of third border member 149. The openings in the mount areas 61*a* that do not align with tabs 113 of reservoir 12 are formed with threaded sleeves 61*a*' that receive the fasteners. The openings in third border 149 which fasten to the side panel 181 are also formed with sleeves 149'.

The truck frame rail 157 has the bottom formed by a bottom facing surface 157*c* and an opposite facing top facing surface 157*a* which forms the top. The bottom facing surface 157*c* and the top facing surface 157*a* each extend from the outward facing surface 157*b*, at opposite ends of the outward facing surface 157*b*, towards the inward end 157*d* of the rail. The inward end 157*d* is closer to the central area delimited by the truck's frame rails than the outward facing surface. The outward surface 157*b* is at the outward end 157*e* of the rail. The bottom surface 157*c* forms an underside of the rail. The bottom facing surface 157*c* is oriented, relative to the top facing surface 157*a*, closer to the ground 190 than the top facing surface 157*a*; and the top facing surface 157*a* is oriented, relative to the bottom surface 157*c*, further from the ground 190 than the bottom facing surface 157*c*. The outward end 157*e* is further from the central area than the inward end 157*d*. The bottom surface 157*c* faces towards the ground 190 upon which the truck having the rail sits. The height of the rail 157 is the distance from the top surface 157*a* to the bottom surface 157*c*. The width of the rail is measured from the outward end 157*e* to the rail inward end 157*d*. The length of the rail is measured along the rails long axis. The height can be measured along the outward surface 157*b*, and the width can be measured along the bottom 157*e* or top 157*a* surface. When the assembly 10 is mounted to the rail 157, at least a portion of the reservoir 12, control block 137, control block mount 140, each overlap the bottom surface 157*c* and bottom of the rail; at least a portion of the reservoir first portion 17, reservoir first end 12*a*, reservoir second portion 18, reservoir second end 12*b*, each overlap the bottom surface 157*c* and bottom of the rail; at least a portion of the control block surface 137*b*, control block mount surface 140*b*, reservoir first interior surface 20, reservoir second exterior surface 23 are opposite and face the bottom surface 157*c*. A portion of the reservoir 12 extends inward of the rail. A portion of the first interior surface and a portion of the second interior surface extend inward of the rail. The assembly third end 10*c* and reservoir third end 12*c* and reservoir third portion are inward of the rail 157. By being inward the items are further from the outward end 157*e* and surface 157*b* than from the inward end 157*d* and surface 157*b*. Portions of the assembly, such as the closure 50 and filter 81 overlap the outward surface 157*b* but do not overlap the bottom surface 157*c*. The assembly fourth end 10*d*, frame fourth end 47*d*, and heat exchanger 127 are outward of the rail outward surface 157*b* and end 157*e*. By being outward the items are further from the inward end 157*d* than the outward end 157*e* and surface 157*b*.

In more detail the reservoir first portion 17 is oriented closer towards the frame first portion 48 than is the reservoir second portion 18. The reservoir third 33 and fifth 39 portions are oriented closer to the frame third end 47*c* than is the reservoir fourth portion 35. The reservoir fifth portion 39 is oriented closer to uprights 59, 61 than is either reservoir third 33 or fourth 35 portion. The fourth portion 35 is oriented closer to the frame fourth end 47*d* than is the reservoir fifth 39 and third portions 33. The reservoir second 18, fourth 35, and sixth 97 portions and reservoir opening 123 are between the assembly fourth end 10*d* and a straight line connecting uprights 59, 61. The line is along ends of each upright 59, 61 closest to the assembly fourth end 10*d*. The reservoir second 18, fourth 35 and sixth 97 portions and reservoir opening 123 are forward of the uprights 59, 61. The distances of the reservoir portions to the frame portions described in this paragraph are measured along a shortest straight from the reservoir portion to the frame portion.

The reservoir third portion 33 is at the third end 10*c* of the assembly and delimits the assembly at the third end 10*c*. The third portion 33 is spaced away from the frame third end 47*c* going in a direction away from the frame fourth 47*d* and third end 47*c*. The third end 33 and third portion 33 of the reservoir are each not between the frame fourth end 47*d* and third end 47*c*. A portion of the fame first portion 48 is at the first end of the first end 10*a* of the assembly.

A portion of reservoir fourth exterior surface 36 and at least a portion of the reservoir fifth exterior surface 40, and the reservoir eighth exterior surface 32 delimit the air chamber 166 going in the second horizontal direction 402 from the air chamber 166 towards the frame third end 47*c*. The eighth exterior surface 32 also delimits the air chamber 166 in the vertical direction 91 from the air chamber 166 to the frame second end 47*b*.

The fourth end 10*d* of the assembly is the front of the assembly and the second end 10*b* is the top of the assembly. The first end 10*a* of the assembly is the bottom. The third end 10*c* is the rear.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A mobile hydraulic cooling assembly comprising:

a hydraulic fluid reservoir defining a hollow chamber, the hydraulic fluid reservoir including a first reservoir portion having a first interior surface delimiting the hollow chamber, the first interior surface having a first end; and a second reservoir portion having a second interior surface delimiting the hollow chamber, the second interior surface having a second end;

wherein the first interior surface and the second interior surface are parallel, in facing relation, and spaced apart, wherein the first end of the first interior surface is not aligned with the second interior surface in a first direction orthogonal to the first interior surface, and wherein the second end of the second interior surface is not aligned with the first interior surface in said first direction.

2. The mobile hydraulic cooling assembly of claim 1 wherein the hydraulic fluid reservoir further includes a third reservoir portion having a third interior surface delimiting the hollow chamber;

a fourth reservoir portion having a fourth interior surface delimiting the hollow chamber;

a fifth reservoir portion having a fifth interior surface delimiting the hollow chamber, at least a portion of the third interior surface and a portion of the fifth interior surface are opposite each other in a second direction orthogonal to the first direction, wherein the third interior surface and fourth interior surface are spaced apart a first distance measured in the second direction, wherein a shortest straight line distance between the portions of the third and fifth interior surfaces opposite each other is less than the first distance which the third and fourth internal surfaces are spaced.

3. The mobile hydraulic cooling assembly of claim 2 wherein the portions of the third interior and fifth interior surfaces opposite each other form part of a sump area of the reservoir.

4. The mobile hydraulic cooling assembly of claim 1 wherein the assembly further comprises a frame coupled to the reservoir.

5. The mobile hydraulic cooling assembly of claim 4 further comprising:

a closure moveable from a closed position to an open position and vice versa, said closure carried by said frame, a fill entry closure covering a fill entry into the reservoir wherein the closure moveable from the closed position to the open position has an interior surface delimiting an open area in the assembly wherein the fill entry closure is disposed in the open area, and when the closure moveable is in the open position, the open area is open to an environment exterior to the closure moveable; and the fill entry closure is accessible by the hands of an operator; and the operator can move the fill entry closure to an open position and fill the reservoir; and wherein when the closure moveable between the open and closed position is in the closed position, the closure moveable closes off the open area so it is not accessible by the hands of an operator.

6. The mobile hydraulic cooling assembly of claim 4 further comprising:

a first open area delimited by a first curved wall of a first respective frame portion of said frame, said first curved wall is proximate a first fitting forming a first suction port, said first suction port is at a first side portion of said reservoir.

7. The mobile hydraulic cooling assembly of claim 6 wherein said first curved wall provides an abutment for the first fitting and reduces strain on a connection between the first fitting and the first side portion when a respective conduit is coupled to the first fitting.

8. The mobile hydraulic cooling assembly of claim 6 wherein said first curved wall delimits the first open area in a direction wherein a vector drawn in the direction delimited has a component going in the vertical direction and a component going in the horizontal direction.

9. The mobile hydraulic cooling assembly of claim 6 wherein a flange of said first respective frame portion forms at least part of said first curved wall.

10. The mobile hydraulic cooling assembly of claim 1 further comprising:

a filter extending into the reservoir hollow chamber, and a fluid outlet is formed in a housing of the filter;

wherein an end surface delimiting an exterior end of the fluid outlet is submerged in hydraulic fluid in the reservoir when the cooling assembly is under normal operation; the end surface is spaced from the surface of the hydraulic fluid in the first direction.

11. The mobile hydraulic cooling assembly of claim 10 further wherein:

the end surface is spaced from the surface of the hydraulic fluid by a minimum distance of 13 cm.

12. The mobile hydraulic cooling assembly of claim 10 wherein:

the end surface is spaced from the second interior surface of the second reservoir portion a distance, measured in the first direction of 25 cm; said second portion is at a top of said reservoir.

13. The mobile hydraulic cooling assembly of claim 1 wherein the hydraulic fluid reservoir further includes an angled reservoir portion having an angled interior surface delimiting the hollow chamber, and wherein the angled interior surface is angled relative to the first interior surface.

14. The mobile hydraulic cooling assembly of claim 13 wherein:

the angle is between 130 and 150 degrees.

15. The mobile hydraulic cooling assembly of claim 2 further comprising:

a heat exchanger;

an air chamber;

wherein the fourth reservoir portion has a fourth exterior surface and said third reservoir portion has a third exterior surface;

wherein at least a portion of said third exterior surface, fourth exterior surface and angled exterior surface delimit the air chamber in a third direction opposite the second direction, said angled exterior surface also delimits the air chamber in the vertical direction; and wherein air is drawn into the air chamber through the heat exchanger and exhausted from the air chamber through an exhaust port when the cooling assembly is in operation, or air is drawn into the air chamber from an inlet port and exhausted from the air chamber through the heat exchanger when the cooling assembly is in operation.

16. The mobile hydraulic cooling assembly of claim 1 wherein the hydraulic cooling assembly is mounted to a truck frame rail including:

a bottom formed by a bottom facing surface and a top formed by a top facing surface, said top facing surface faces a direction opposite the bottom facing surface, said bottom facing surface forms an underside of the truck frame rail;

an outward end formed by an outward facing surface;

wherein the top facing surface and bottom facing surface each extend away from the outward facing surface, at opposite ends of the outward facing surface to an inward end of the rail; and wherein the cooling assembly when mounted to the truck frame rail has a particular orientation relative to said truck frame rail, wherein at least a portion of two of said plurality of reservoir portions having an interior surface delimiting said hollow chamber overlaps the bottom facing surface and the bottom of said truck frame rail.

17. The mobile hydraulic cooling assembly of claim 16 wherein:

the portions of the two reservoir portions overlapping the bottom facing surface and bottom of said rail are at least a portion of the reservoir first portion and at least a portion of the reservoir second portion.

18. The mobile hydraulic cooling assembly of claim 17 wherein:

the at least the portion of the reservoir first interior surface and at least a portion of a second exterior surface of said second reservoir portion face the bottom facing surface.

19. The mobile hydraulic cooling assembly of claim 17 wherein:

a portion of the reservoir first portion and a portion of the reservoir second portion each extend inward of the frame rail wherein by being inward of the frame rail these portion are further from the rail outward end than from the rail inward end.

20. The mobile hydraulic cooling assembly of claim 17 wherein:

a third portion of said plurality of reservoir portions is inward of the frame rail.

21. The mobile hydraulic cooling assembly of claim 1, wherein none of the first interior surface aligns with the second interior surface in said first direction.

22. A mobile hydraulic cooling assembly comprising:

a hydraulic fluid reservoir defining a hollow chamber, the hydraulic fluid reservoir including a first reservoir portion having a first interior surface delimiting the hollow chamber, the first interior surface having a first end; and a second reservoir portion having a second interior surface delimiting the hollow chamber, the second interior surface having a second end, wherein the first interior surface and the second interior surface are parallel, in facing relation, and spaced apart along an axis that is orthogonal to at least one of the first and second interior surfaces, wherein a first line extending from the first end of the first interior surface parallel to the axis does not intersect the second interior surface, and wherein a second line extending from the second end of the second interior surface parallel to the axis does not intersect the first interior surface.

23. The mobile hydraulic cooling assembly of claim 22, wherein a third line extending from a third end of the first interior surface parallel to the axis does not intersect the second interior surface, and wherein a fourth line extending from a fourth end of the second interior surface parallel to the axis does not intersect the first interior surface.

24. A mobile hydraulic cooling assembly, comprising;

a hydraulic fluid reservoir defining a hollow chamber, the hollow chamber including a first volume defined by a first reservoir portion having a first interior surface, a second reservoir portion having a second interior surface, and a third reservoir portion having a third interior surface parallel with the second interior surface, each of the second reservoir portion and the third reservoir portion extending from the first reservoir portion, and a second volume defined by a fourth reservoir portion having a fourth interior surface, a fifth reservoir portion having a fifth interior surface, and a sixth reservoir portion having a sixth interior surface parallel with the fifth interior surface, each of the fifth reservoir portion and the sixth reservoir portion extending from the fourth reservoir portion, wherein the first volume and the second volume are located on opposite sides of a first plane, wherein the first interior surface and the fourth interior surface are orthogonal to the first plane, and wherein each of the second interior surface and the third interior surface does not intersect a second plane coincident with the fourth interior surface.

25. The mobile hydraulic cooling assembly of claim 24, wherein each of the fifth interior surface and the sixth interior surface does not intersect a third plane coincident with the first interior surface.

26. The mobile hydraulic cooling assembly of claim 24, wherein the second interior surface, the third interior surface, the fifth interior surface, and the sixth interior surface are parallel to the first plane.

* * * * *